US008172377B2

(12) United States Patent
Okumura et al.

(10) Patent No.: US 8,172,377 B2
(45) Date of Patent: May 8, 2012

(54) IMAGE FORMING APPARATUS

(75) Inventors: Takayuki Okumura, Osaka (JP); Akihiro Takami, Osaka (JP)

(73) Assignee: Kyocera Mita Corporation (JP)

( * ) Notice: Subject to any disclaimer, the term of this patent is extended or adjusted under 35 U.S.C. 154(b) by 856 days.

(21) Appl. No.: 12/176,667

(22) Filed: Jul. 21, 2008

(65) Prior Publication Data

US 2009/0028596 A1 Jan. 29, 2009

(30) Foreign Application Priority Data

Jul. 27, 2007 (JP) ..... 2007-196298

(51) Int. Cl.

| | |
|---|---|
| ***B41J 2/195*** | (2006.01) |
| ***B41J 29/38*** | (2006.01) |
| ***B41J 29/393*** | (2006.01) |
| ***B41J 2/17*** | (2006.01) |
| ***B41J 2/175*** | (2006.01) |
| ***G03G 21/20*** | (2006.01) |

(52) U.S. Cl. ..... 347/85; 347/7; 347/17; 347/19; 347/84; 399/94; 399/97

(58) Field of Classification Search ..... None
See application file for complete search history.

(56) References Cited

U.S. PATENT DOCUMENTS

2006/0192809 A1* 8/2006 Nakashima ..... 347/22
2006/0214983 A1 9/2006 Teshima et al.

FOREIGN PATENT DOCUMENTS

JP 2004-196505 7/2004
JP 2006-264174 10/2006

* cited by examiner

*Primary Examiner* — Matthew Luu
*Assistant Examiner* — Kendrick Liu
(74) *Attorney, Agent, or Firm* — Gerald E. Hespos; Michael J. Porco

(57) ABSTRACT

An image forming apparatus includes: a transporter for transporting a sheet; an image forming section for forming an image on the sheet being transported by the transporter with an ink; a liquid absorbent member; a cleaning liquid feeding section for feeding a cleaning liquid to the transporter via the liquid absorbent member to clean the transporter adhered with ink residues; and a cleaning liquid feeding controlling section for controlling the cleaning liquid feeding section to perform the cleaning liquid feeding operation, based on a condition of the image forming apparatus relating to evaporation of the cleaning liquid. This arrangement enables to properly clean a transport belt in an inkjet image forming apparatus, while preventing waste of the cleaning liquid and securing stable driving of the transport belt.

17 Claims, 19 Drawing Sheets

| TEMPERATURE (°C) | AMOUNT OF SATURATED WATER VAPOR (g/m³) |
|---|---|
| 20 | 17.3 |
| 25 | 23.0 |
| 30 | 30.4 |
| 35 | 39.6 |
| 40 | 51.1 |
| 45 | 65.3 |
| 50 | 82.9 |

T1

| TEMPERATURE (°C) / HUMIDITY (%) | 20 | 25 | 30 | 35 | 40 | 45 |
|---|---|---|---|---|---|---|
| 20 | 13.8 | 18.4 | 24.3 | 31.7 | 40.9 | 52.2 |
| 30 | 12.1 | 16.1 | 21.2 | 27.7 | 35.8 | 45.7 |
| 40 | 10.4 | 13.8 | 18.2 | 23.8 | 30.7 | 39.1 |
| 50 | 8.7 | 11.5 | 15.3 | 19.8 | 25.6 | 32.6 |
| 60 | 6.9 | 9.2 | 12.2 | 15.8 | 20.5 | 26.1 |
| 70 | 5.2 | 6.9 | 9.2 | 11.9 | 15.5 | 19.6 |

FIG. 5

T2

| ALLOWABLE AMOUNT OF WATER VAPOR TO BE EVAPORATED($g/m^3$) | 0–9.9 | 10–14.9 | 15.0–19.9 | 20.0–24.9 | 25.0–29.9 | 30.0–34.9 | 35.0–39.9 | 40.0–44.9 | 45.0–49.9 | 50.0–54.9 |
|---|---|---|---|---|---|---|---|---|---|---|
| CYCLE (sec) | 45 | 39 | 33 | 28 | 24 | 21 | 18 | 16 | 13 | 10 |

FIG. 9A

T3

| ALLOWABLE AMOUNT OF WATER VAPOR TO BE EVAPORATED(g/m³) | 0–9.9 | 10–14.9 | 15.0–19.9 | 20.0–24.9 | 25.0–29.9 | 30.0–34.9 | 35.0–39.9 | 40.0–44.9 | 45.0–49.9 | 50.0–54.9 |
|---|---|---|---|---|---|---|---|---|---|---|
| CYCLE (sec) | 41 | 35 | 30 | 25 | 22 | 19 | 16 | 14 | 12 | 9 |

FIG. 9B

T4

| ALLOWABLE AMOUNT OF WATER VAPOR TO BE EVAPORATED(g/m³) | 0–9.9 | 10–14.9 | 15.0–19.9 | 20.0–24.9 | 25.0–29.9 | 30.0–34.9 | 35.0–39.9 | 40.0–44.9 | 45.0–49.9 | 50.0–54.9 |
|---|---|---|---|---|---|---|---|---|---|---|
| CYCLE (sec) | 37 | 31 | 26 | 22 | 19 | 17 | 14 | 13 | 10 | 8 |

FIG. 16A

T5

| ALLOWABLE AMOUNT OF WATER VAPOR TO BE EVAPORATED(g/m³) | 0-9.9 | 10-14.9 | 15.0-19.9 | 20.0-24.9 | 25.0-29.9 | 30.0-34.9 | 35.0-39.9 | 40.0-44.9 | 45.0-49.9 | 50.0-54.9 |
|---|---|---|---|---|---|---|---|---|---|---|
| CYCLE (sec) | 34 | 28 | 23 | 20 | 17 | 15 | 13 | 12 | 9 | 7 |

FIG. 16B

T6

| ALLOWABLE AMOUNT OF WATER VAPOR TO BE EVAPORATED(g/m³) | 0-9.9 | 10-14.9 | 15.0-19.9 | 20.0-24.9 | 25.0-29.9 | 30.0-34.9 | 35.0-39.9 | 40.0-44.9 | 45.0-49.9 | 50.0-54.9 |
|---|---|---|---|---|---|---|---|---|---|---|
| CYCLE (sec) | 31 | 25 | 21 | 18 | 15 | 14 | 12 | 11 | 8 | 6 |

FIG. 16C

T7

| ALLOWABLE AMOUNT OF WATER VAPOR TO BE EVAPORATED(g/m³) | 0-9.9 | 10-14.9 | 15.0-19.9 | 20.0-24.9 | 25.0-29.9 | 30.0-34.9 | 35.0-39.9 | 40.0-44.9 | 45.0-49.9 | 50.0-54.9 |
|---|---|---|---|---|---|---|---|---|---|---|
| CYCLE (sec) | 28 | 22 | 18 | 16 | 13 | 12 | 11 | 10 | 7 | 5 |

IMAGE FORMING APPARATUS

BACKGROUND OF THE INVENTION

1. Field of the Invention

The present invention relates to an inkjet image forming apparatus for forming an image on a sheet by ejecting an ink onto the sheet.

2. Description of the Related Art

Heretofore, there has been widely known an inkjet image forming apparatus for forming an image on a sheet by ejecting an ink onto the sheet from an inkjet head, based on image information read out or transmitted from the other device. The inkjet image forming apparatus is generally built-in with an endless transport belt at a predetermined position opposing to the inkjet head to transport a sheet. The image forming apparatus is operable to form an image on a sheet by ejecting an ink from the inkjet head onto the sheet being transported by the transport belt.

In the inkjet image forming apparatus, in view of likelihood that the ink ejected from the inkjet head may adhere to the transport belt and smear the transport belt, it is an ordinary practice to clean the transport belt by contacting an absorbent member having absorbed a cleaning liquid with the transport belt, as disclosed in e.g. Japanese Unexamined Patent Publication No. 2006-264174 (prior art D1) and Japanese Unexamined Patent Publication No. 2004-196505 (prior art D2).

Prior art D1 relates to a technology of cleaning a transport belt, wherein a cleaning liquid is periodically supplied to an absorbent member, considering likelihood that a large frictional force may be generated between the transport belt and the absorbent member due to shortage of the cleaning liquid absorbed in the absorbent member, and consequently driving of the transport belt may be unstable. Prior Art D2 discloses that purified water is used as a cleaning liquid.

A cleaning liquid for use in cleaning a transport belt may evaporate, considering that the cleaning liquid is a solution. For instance, evaporation rate of the cleaning liquid is different depending on environmental conditions such as the ambient temperature, the ambient humidity, or the air flowing velocity in the image forming apparatus. Prior art D1 and D2 do not consider the abovementioned matter. Accordingly, in the case where the cleaning liquid is used in a condition that the cleaning liquid is relatively less likely to evaporate, the cleaning liquid may be excessively fed to the transport belt despite that the transport belt is sufficiently wet with the cleaning liquid. This may cause waste of the cleaning liquid. On the other hand, in the case where the cleaning liquid is used in a condition that the cleaning liquid is relatively highly likely to evaporate, feeding of the cleaning liquid to the transport belt may be insufficient despite that the transport belt is dry. This may cause unstable driving of the transport belt resulting from an increase in frictional force between the transport belt and the absorbent member.

SUMMARY OF THE INVENTION

In view of the above conventional examples, it is an object of the present invention to provide an inkjet image forming apparatus that enables to properly clean a transport belt, while preventing waste of a cleaning liquid and securing stable driving of the transport belt.

An image forming apparatus according to an aspect of the invention includes: a transporter for transporting a sheet; an image forming section for forming an image on the sheet being transported by the transporter with an ink; a liquid absorbent member; a cleaning liquid feeding section for feeding a cleaning liquid to the transporter via the liquid absorbent member to clean the transporter adhered with ink residues; and a cleaning liquid feeding controlling section for controlling the cleaning liquid feeding section to perform the cleaning liquid feeding operation, based on a condition of the image forming apparatus relating to evaporation of the cleaning liquid.

These and other objects, features and advantages of the present invention will become more apparent upon reading the following detailed description along with the accompanying drawings.

BRIEF DESCRIPTION OF THE DRAWINGS

FIG. 5 is a chart showing a first cleaning liquid feeding cycle table representing an example of a relation between allowable amounts of water vapor to be evaporated, and cleaning liquid feeding cycles.

FIG. 9A is a chart showing a second cleaning liquid feeding cycle table representing an example of a relation between allowable amounts of water vapor to be evaporated, and cleaning liquid feeding cycles.

FIG. 9B is a chart showing a third cleaning liquid feeding cycle table representing an example of a relation between allowable amounts of water vapor to be evaporated, and cleaning liquid feeding cycles.

FIG. 16A is a chart showing a fourth cleaning liquid feeding cycle table representing an example of a relation between allowable amounts of water vapor to be evaporated, and cleaning liquid feeding cycles in the fourth embodiment.

FIG. 16B is a chart showing a fifth cleaning liquid feeding cycle table representing an example of a relation between allowable amounts of water vapor to be evaporated, and cleaning liquid feeding cycles in the fourth embodiment.

FIG. 16C is a chart showing a sixth cleaning liquid feeding cycle table representing an example of a relation between allowable amounts of water vapor to be evaporated, and cleaning liquid feeding cycles in the fourth embodiment.

DETAILED DESCRIPTION OF THE PREFERRED EMBODIMENTS

In the following, embodiments of the invention are described referring to the accompanying drawings. The following embodiments are merely examples embodying the invention, and do not limit the technical scope of the invention.

First Embodiment

Figure 1:
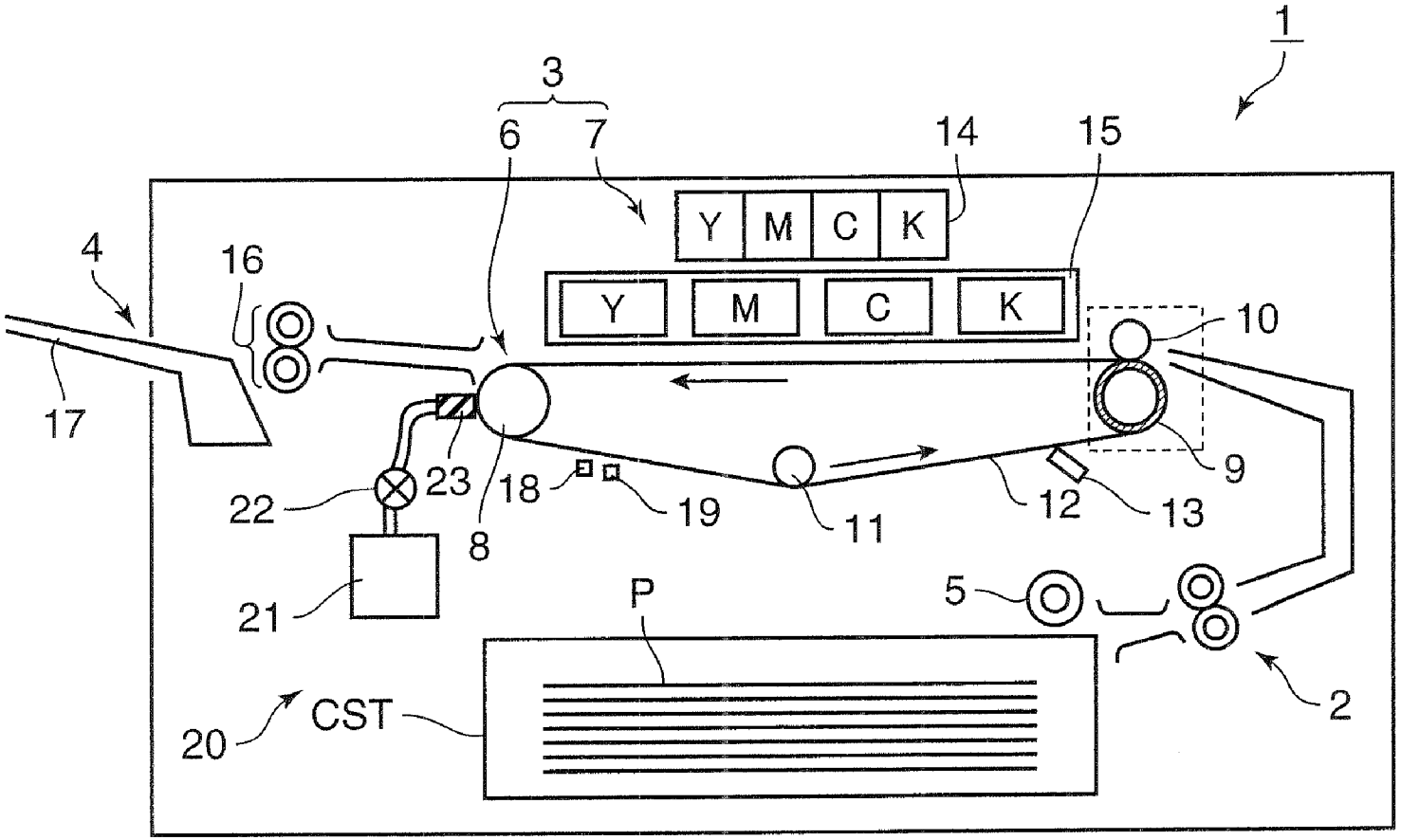
FIG. 1 is a diagram showing an arrangement of an inkjet image forming apparatus in accordance with a first embodiment of the invention.

FIG. 1 is a diagram showing an arrangement of an inkjet image forming apparatus in accordance with the first embodiment of the invention. As shown in FIG. 1, the image forming apparatus 1 includes a paper storing section 2 located at a lower part of the image forming apparatus 1, an image forming section 3 located above the paper storing section 2, and a sheet discharging section 4 located downstream with respect to the image forming section 3.

The paper storing section 2 has a sheet cassette CST, and is operable to dispense sheets P stacked in the sheet cassette CST one by one from an uppermost sheet by a rotating operation of a feed roller 5 urged toward the stacked sheets P by an unillustrated urging mechanism such as a spring, whereby the uppermost sheet is fed toward the image forming section 3.

The image forming section 3 includes a sheet transporting section 6 for transporting a sheet P supplied from the paper storing section 2 toward the sheet discharging section 4, and an ink ejecting section 7 for ejecting an ink onto the sheet P being transported by the sheet transporting section 6.

The sheet transporting section 6 includes a drive roller 8, a driven roller 9, a suction roller 10, a tension roller 11, a transport belt 12 as a transporter, and a cleaning blade 13. The transport belt 12 is an endless belt having an outer layer thereof made of chloroprene rubber. The transport belt 12 is stretched between the drive roller 8, the driven roller 9 and the tension roller 11. The drive roller 8 is a roller which is drivingly rotated counterclockwise by an unillustrated motor. When the drive roller 8 is drivingly rotated, the transport belt 12 is driven counterclockwise, and the driven roller 9 and the tension roller 11 are rotated counterclockwise, following the driving of the transport belt 12. The tension roller 11 is a roller for regulating a tension of the transport belt 12 to keep the transport belt 12 in a properly stretched condition. The suction roller 10 is disposed as opposed to the driven roller 9 in contact with the transport belt 12. A sheet supplied from the paper storing section 2 is electrostatically attracted to the transport belt 12 by electrostatically charging the transport belt 12. In this arrangement, the sheet transporting section 6 is operable to transport a sheet supplied from the paper storing section 2 toward the sheet discharging section 4 (i.e. in a leftward direction from the right side in FIG. 1), while electrostatically attracting the sheet to the transport belt 12.

The cleaning blade 13 is disposed in sliding contact with the transport belt 12 at an appropriate position on a transport surface of the transport belt 12, which is driven in backward direction from the drive roller 8 toward the driven roller 9, and after ink residues or the like adhered to the transport surface of the transport belt 12 are brought to an easily removable state by a cleaning liquid applied to the transport surface by a liquid absorbent member 23 which has absorbed the cleaning liquid supplied from a below-mentioned cleaning liquid feeding section 20, the ink residues or the like are scraped and removed from the transport surface.

The ink ejecting section 7 includes an ink reservoir 14 for storing an ink, and an inkjet head 15 for ejecting the ink from the ink reservoir 14 at a predetermined position on a sheet being transported by the sheet transporting section 6. In the first embodiment, the ink reservoir 14 is partitioned into a plurality of ink chambers by the number corresponding to the number of colors of inks. Specifically, yellow ink, magenta ink, cyan ink and black ink are stored in the ink chambers, respectively. As shown in FIG. 1, the inkjet head 15 is provided in the number of four along the sheet transport path in correspondence to the inks.

Although detailed description on the inkjet head 15 is omitted herein, the inkjet head 15 includes a number of holes through which an ink is ejected onto a sheet, pressurization chambers formed in correspondence to the respective ejection ports, and piezoelectric elements and oscillation plates provided in correspondence to the respective pressurization chambers. The inkjet head 15 is constructed in such a manner that: each oscillation plate is oscillated by deformation of the corresponding piezoelectric element upon application of a predetermined drive pulse to the piezoelectric element; the ink fed from the ink reservoir 14 is pressurized in the corresponding pressurization chamber by the oscillation; and the pressurized ink is ejected onto the sheet through the corresponding ejection port as an ink droplet. Referring to FIG. 1, an unillustrated sheet end detection sensor, constituted of a light emitter and a light detector, for detecting a leading end of a sheet, is arranged at a position between the suction roller 10 and the inkjet head 15, as opposed to the transport belt 12. Upon lapse of a predetermined time after the leading end of the sheet is detected by the sheet end detection sensor, the inkjet head 15 starts ejecting an ink for image formation from the upstream-most inkjet head 15.

The sheet discharging section 4 is constructed in such a manner that the sheet transported by the sheet transporting section 6 is discharged onto a discharging tray 17 by a pair of discharging rollers 16 disposed as opposed to each other.

In addition to the abovementioned elements, the image forming apparatus 1 includes a temperature sensor 18 as a temperature detecting section, a humidity sensor 19 as a humidity detecting section, the cleaning liquid feeding section 20 and the liquid absorbent member 23. In the first embodiment, the temperature sensor 18 and the humidity sensor 19 are disposed at a position in proximity to the transport surface of the transport belt 12, between the drive roller 8 and the tension roller 11. The temperature sensor 18 is adapted to detect an ambient temperature in the interior of the image forming apparatus 1. The humidity sensor 19 is adapted to detect an ambient humidity in the interior of the image forming apparatus 1. The arranged positions of the temperature sensor 18 and the humidity sensor 19 are not limited to the above-mentioned positions.

The cleaning liquid feeding section 20 is disposed near the drive roller 8, and includes a cleaning liquid reservoir 21 for storing a cleaning liquid, and a pump 22 for feeding the cleaning liquid from the cleaning liquid reservoir 21 to the liquid absorbent member 23. In the first embodiment, the cleaning liquid contains purified water and a preservative or the like, as an additive, for keeping the purified water from deterioration.

The liquid absorbent member 23 is a member which absorbs the cleaning liquid fed by the pump 22, and applies the absorbed cleaning liquid on a surface of the transport belt 12 stretched around the drive roller 8. The liquid absorbent member 23 is composed of e.g. a polyurethane porous material. The liquid absorbent member 23 is contacted with the surface of the transport belt 12 to apply the cleaning liquid on the surface of the transport belt 12.

Figure 2:
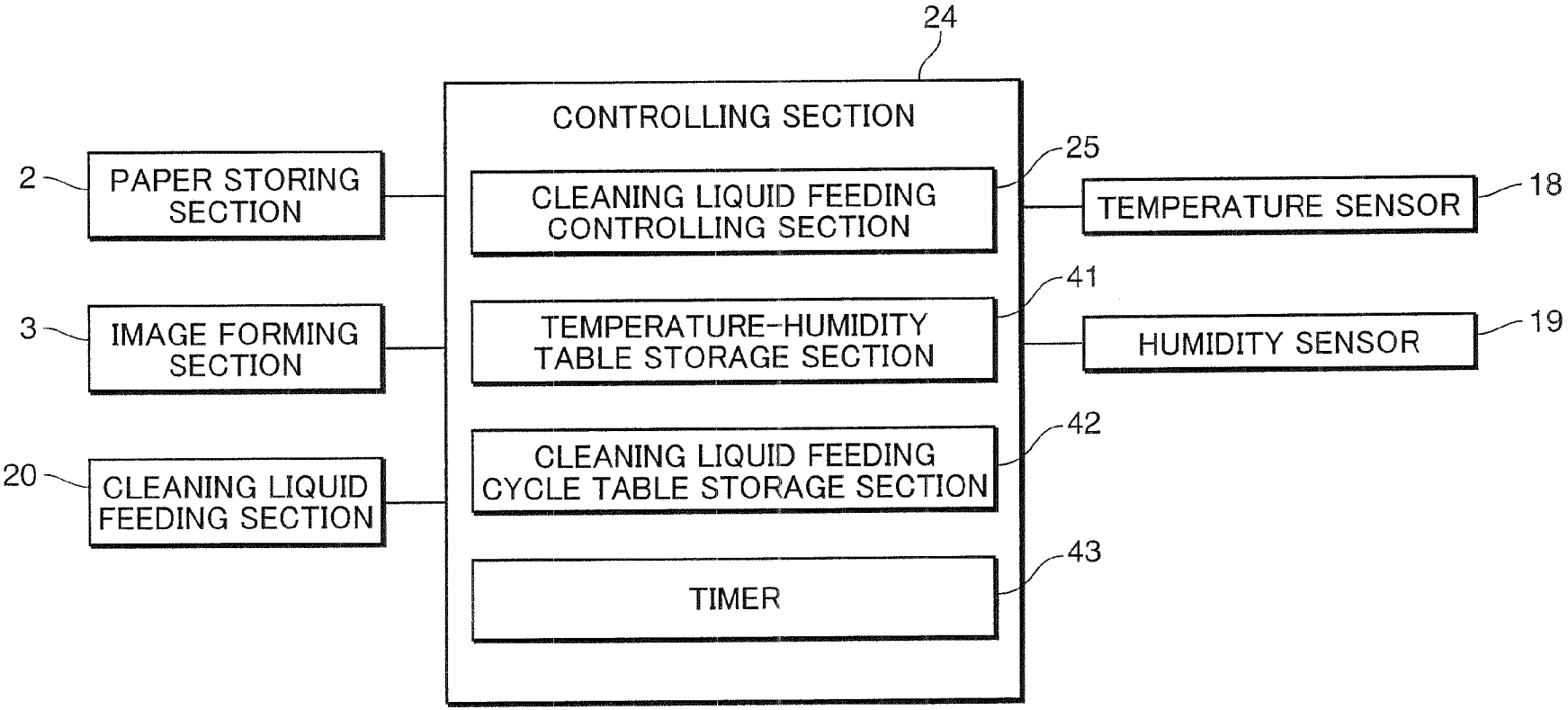
FIG. 2 is a block diagram showing an electrical configuration of the image forming apparatus in accordance with the first embodiment of the invention.

FIG. 2 is a block diagram showing an electrical configuration of the image forming apparatus 1. As shown in FIG. 2, the image forming apparatus 1 includes a paper storing section 2, an image forming section 3, a cleaning liquid feeding section 20, a temperature sensor 18, a humidity sensor 19, and a controlling section 24. The paper storing section 2, the image forming section 3, the cleaning liquid feeding section 20, the temperature sensor 18, and the humidity sensor 19 shown in FIG. 2 respectively correspond to the paper storing section 2, the image forming section 3, the cleaning liquid feeding section 20, the temperature sensor 18, and the humidity sensor 19 shown in FIG. 1. The temperature sensor 18 outputs detected temperature information to the controlling section 24. The humidity sensor 19 outputs detected humidity information to the controlling section 24.

The controlling section 24 is constituted of an ROM for storing various control programs and the like, an RAM for temporarily storing data, and a central processing unit (CPU) for reading out the control programs and the like for execution. In the first embodiment, the controlling section 24 functionally includes a cleaning liquid feeding controlling section 25 for controlling the cleaning liquid feeding section 20 to perform a cleaning liquid feeding operation, a temperature-humidity table storage section 41, a cleaning liquid feeding cycle table storage section 42, and a timer 43. The cleaning liquid feeding controlling section 25 controls the pump 22 in the cleaning liquid feeding section 20 to feed the cleaning liquid based on the temperature information acquired from the temperature sensor 18 and the humidity information acquired from the humidity sensor 19.

Before driving of the transport belt 12 is started based on a command for image formation, the cleaning liquid feeding controlling section 25 causes the cleaning liquid feeding section 20 to perform a cleaning liquid feeding operation for a predetermined time (e.g. 2 seconds); and then, after the driving of the transport belt 12 is started, the cleaning liquid feeding controlling section 25 causes the cleaning liquid feeding section 20 to perform a cleaning liquid feeding operation for a predetermined time (e.g. 1.5 seconds) at a predetermined cycle. In the first embodiment, the feeding cycle of the cleaning liquid feeding operation to be performed after the driving of the transport belt 12 is started, is defined depending on an allowable amount of water vapor to be evaporated, which will be described later. In this embodiment, the feeding cycle means a time interval from a point of time when the cleaning liquid is started to be fed by the cleaning liquid feeding section 20 to a point of time when the cleaning liquid is started to be fed by the cleaning liquid feeding section 20 in a succeeding feeding operation.

Figures 3A, 3B, 4:
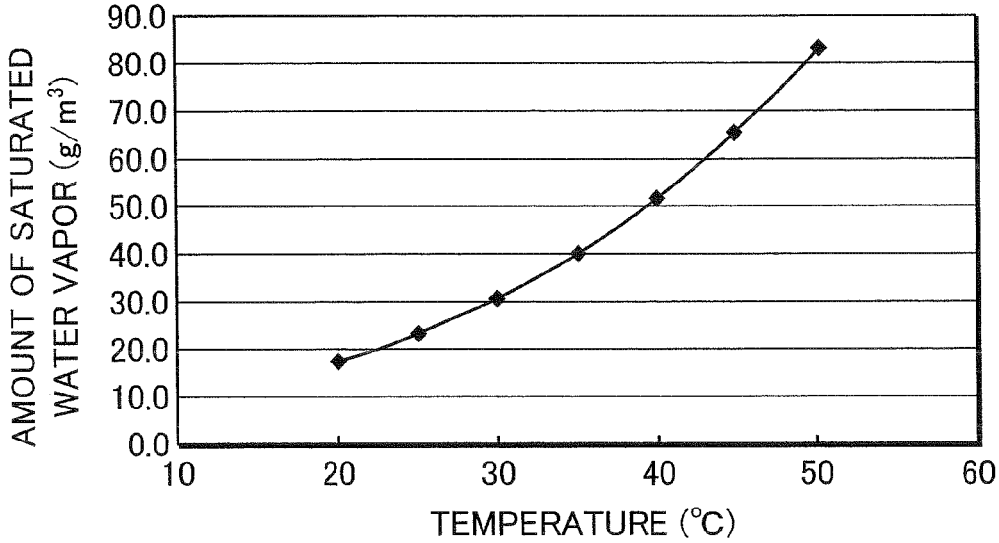
FIG. 3A is a graph showing a relation between ambient temperatures in the range from 20° C. to 50° C., and amounts of saturated water vapor.
FIG. 3B is a chart showing a part of the relation shown in FIG. 3A in the form of numerical values.
FIG. 4 is a chart showing a temperature-humidity table representing an example of a relation between combinations of temperature and humidity, and allowable amounts of water vapor to be evaporated.

FIG. 3A is a graph showing a relation between ambient temperatures in the range from 20° C. to 50° C., and amounts of saturated water vapor. FIG. 3B is a chart showing a part of the relation shown in FIG. 3A in the form of numerical values. As shown in FIGS. 3A and 3B, generally, the higher the ambient temperature is, the larger the amount of saturated water vapor is.

FIG. 4 is a chart showing how much water vapor the ambient air can further hold, in combination of the ambient temperatures shown in FIG. 3B with humidities (i.e. relative humidities, hereinafter, a relative humidity is simply called as a "humidity" or "ambient humidity") of 20(%), 30(%), 40(%), 50(%), 60(%), and 70(%). Specifically, as shown in FIG. 4, for instance, in the case the ambient temperature is 25° C., and the ambient humidity is 60%, the amount of water vapor held in the ambient air is 23.0×0.6=13.8 (g/m$^3$). The amount of saturated water vapor at the ambient temperature of 25° C. is 23.0 (g/m$^3$). Accordingly, the ambient air can further hold water vapor in the amount of 23−13.8=9.2 (g/m$^3$). The aforementioned allowable amount of water vapor to be evaporated corresponds to a difference between the amount of saturated water vapor and the amount of water vapor actually held in the ambient air with respect to an air at a certain temperature and a certain humidity.

The temperature-humidity table storage section 41 stores a temperature-humidity table T1 showing a relation between an ambient temperature in the interior of the image forming apparatus 1, an ambient humidity in the interior of the image forming apparatus 1, and an allowable amount of water vapor to be evaporated. Specifically, the temperature-humidity table storage section 41 stores allowable amounts of water vapor to be evaporated corresponding to combinations of temperature and humidity as shown in FIG. 4 in the form of e.g. a table.

The cleaning liquid feeding cycle table storage section 42 stores a cleaning liquid feeding cycle table T2 showing a relation between an allowable amount of water vapor to be evaporated, and a time interval i.e. a feeding cycle at which a cleaning liquid is to be fed from the cleaning liquid feeding section 20. Specifically, the cleaning liquid feeding cycle table storage section 42 prestores a relation between allowable amounts of water vapor to be evaporated, and cleaning liquid feeding cycles in the form of e.g. a table. FIG. 5 is a chart showing a cleaning liquid feeding cycle table (a first cleaning liquid feeding cycle table) T2 representing an example of the relation between allowable amounts of water vapor to be evaporated, and cleaning liquid feeding cycles. As shown in FIG. 5, for instance, in the case where the allowable amount of water vapor to be evaporated in the ambient air in the interior of the image forming apparatus 1 is in the range from 10 to 14.9 (g/m$^3$), the cleaning liquid feeding controlling section 25 causes the cleaning liquid feeding section 20 to perform a cleaning liquid feeding operation for a predetermined time (e.g. 1.5 seconds) at a time interval of 39 seconds.

In the embodiment, the cleaning liquid feeding cycle table is defined in such a manner that the time interval is decreased, as the allowable amount of water vapor to be evaporated is increased, considering the following points. Specifically, in the case where the allowable amount of water vapor to be evaporated is large, the cleaning liquid applied on the transport belt 12 or absorbed in the liquid absorbent member 23 actively evaporates, as compared with a case that the allowable amount of water vapor to be evaporated is small. As a result, the transport belt 12 or the liquid absorbent member 23 is likely to be dried.

The cleaning liquid feeding controlling section 25 retrieves, from the temperature-humidity table T1, an allowable amount of water vapor to be evaporated corresponding to a temperature detected by the temperature sensor 18 and a humidity detected by the humidity sensor 19; retrieves, from the cleaning liquid feeding cycle table T2, a time interval corresponding to the retrieved allowable amount of water vapor to be evaporated; and controls the cleaning liquid feeding section 20 to perform a cleaning liquid feeding operation depending on the retrieved time interval.

As described above, in the case where the transport belt 12 or the liquid absorbent member 23 is dry, a frictional force between the transport belt 12 and the liquid absorbent member 23, or a frictional force between the transport belt 12 and the cleaning blade 13 is increased. As a result, driving of the transport belt 12 may be unstable. Also, it is less likely to remove ink residues or the like adhered to the transport belt 12 by the cleaning blade 13. In view of the above, in the case where the allowable amount of water vapor to be evaporated is large, the cleaning liquid feeding controlling section 25 controls the cleaning liquid feeding section 20 to perform a cleaning liquid feeding operation at a relatively short time interval, as compared with a case that the allowable amount of water vapor to be evaporated is small, so as to keep the transport belt 12 or the liquid absorbent member 23 from drying.

In the case where the allowable amount of water vapor to be evaporated is relatively small, the cleaning liquid applied on the transport belt 12 or the cleaning liquid absorbed in the liquid absorbent member 23 is less likely to evaporate. Accordingly, it is conceived that the transport belt 12 is in a relatively wet state. In view of this, the cleaning liquid feeding time interval is set to a relatively large value to prevent or suppress an excessive feeding operation of the cleaning liquid.

The cleaning liquid feeding controlling section 25 retrieves, from e.g. the temperature-humidity table T1 as shown in FIG. 4, an allowable amount of water vapor to be evaporated, based on a temperature indicated by temperature information acquired from the temperature sensor 18 and a humidity indicated by humidity information acquired from the humidity sensor 19; and retrieves, from e.g. the cleaning liquid feeding cycle table T2 shown in FIG. 5, a feeding cycle at which the cleaning liquid is to be fed to the liquid absorbent member 23, based on the retrieved allowable amount of water vapor to be evaporated. Specifically, the cleaning liquid feeding controlling section 25 retrieves an allowable amount of water vapor to be evaporated corresponding to a temperature indicated by temperature information acquired from the temperature sensor 18, and a humidity indicated by humidity information acquired from the humidity sensor 19, by referring to e.g. the temperature-humidity table T1 as shown in FIG. 4. Then, the cleaning liquid feeding controlling section 25 retrieves a cleaning liquid feeding cycle corresponding to the retrieved allowable amount of water vapor to be evaporated, by referring to e.g. the cleaning liquid feeding cycle table T2 shown in FIG. 5. Then, the cleaning liquid feeding controlling section 25 causes the cleaning liquid feeding section 20 to perform a cleaning liquid feeding operation at the retrieved cleaning liquid feeding cycle.

Figure 6:
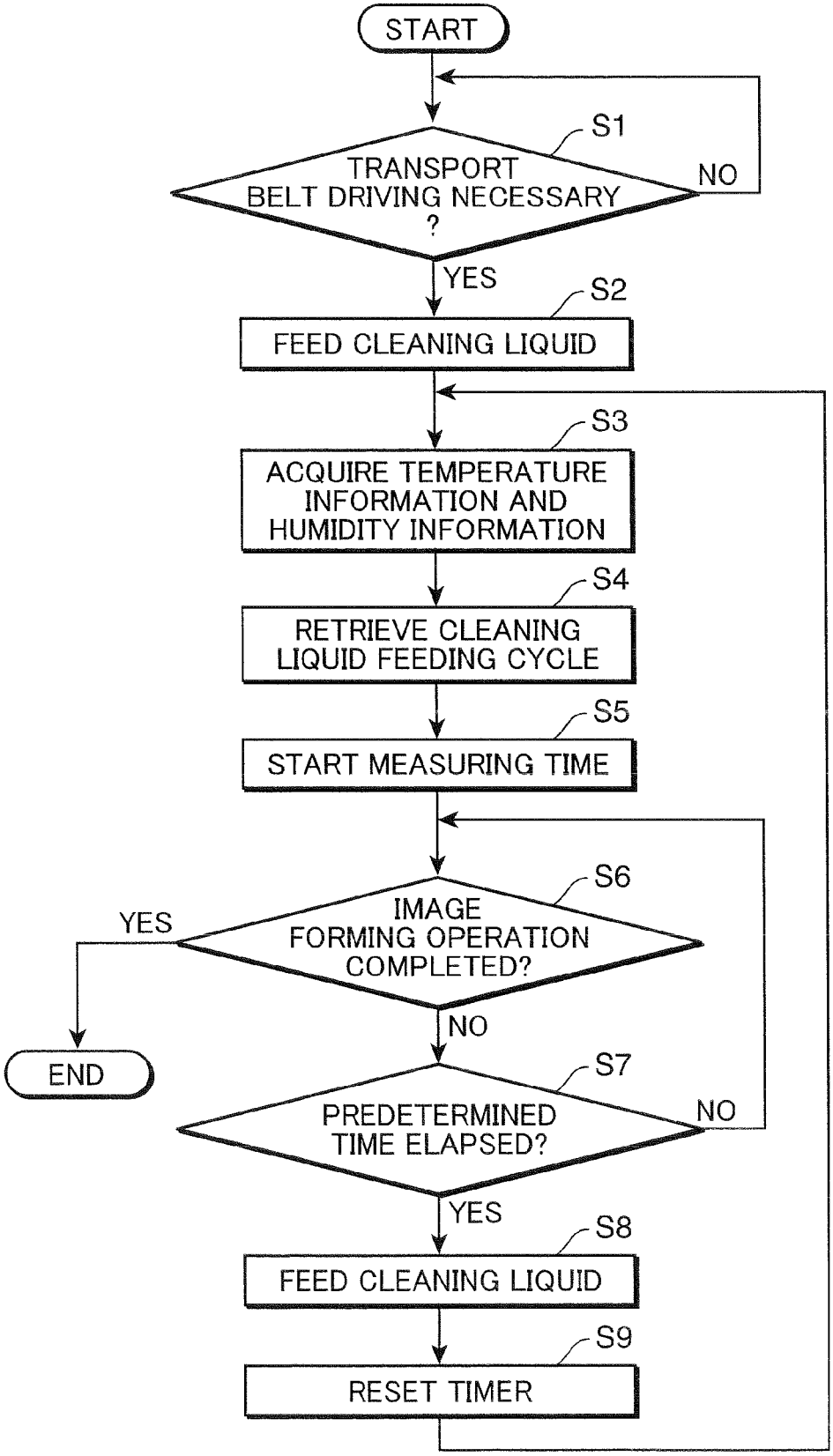
FIG. 6 is a flowchart showing a cleaning liquid feeding control operation to be performed by a cleaning liquid feeding controlling section in the first embodiment.

FIG. 6 is a flowchart showing a cleaning liquid feeding control operation to be performed by the cleaning liquid feeding controlling section 25.

Referring to FIG. 6, first, the controlling section 24 judges whether it is necessary to drive the transport belt 12, based on a user's command for image formation, a checkup operation to be performed when the image forming apparatus 1 is started up, or a like operation (Step S1). If it is judged that driving of the transport belt 12 is necessary (YES in Step S1), the cleaning liquid controlling section 25 causes the cleaning liquid feeding section 20 to perform a cleaning liquid feeding operation for e.g. 2 seconds (Step S2). Thereafter, the controlling section 24 starts driving the transport belt 12. If, on the other hand, it is judged that driving of the transport belt 12 is not necessary (NO in Step S1), the transport belt 12 is brought to a standby state.

Then, the cleaning liquid feeding controlling section 25 acquires temperature information from the temperature sensor 18, and acquires humidity information from the humidity sensor 19 (Step S3). Then, the cleaning liquid feeding controlling section 25 retrieves, from the temperature-humidity table T1 as shown in FIG. 4, an allowable amount of water vapor to be evaporated, based on the temperature indicated by the acquired temperature information and the humidity indicated by the acquired humidity information. Then, the cleaning liquid feeding controlling section 25 retrieves, from e.g. the cleaning liquid feeding cycle table T2 shown in FIG. 5, a cleaning liquid feeding cycle, based on the retrieved allowable amount of water vapor to be evaporated (Step S4). Then, the cleaning liquid feeding controlling section 25 controls the timer 43 to start measuring a time (Step S5).

Then, the cleaning liquid feeding controlling section 25 judges whether an image forming operation has been completed (Step S6). Completion of an image forming operation in the embodiment means that an electric power supply to an unillustrated drive source for rotating the drive roller 8 so as to drive the transport belt 12 shown in FIG. 1 is suspended. Alternatively, a sensor for detecting a rotation state of the drive roller 8 may be provided, and completion of an image forming operation may be defined by suspending rotation of the drive roller 8. If it is judged that an image forming operation has been completed (YES in Step S6), the series of operations to be performed by the cleaning liquid feeding controlling section 25 is terminated.

If, on the other hand, it is judged that an image forming operation has not been completed (NO in Step S6), the cleaning liquid feeding controlling section 25 judges whether a predetermined time corresponding to the cleaning liquid feeding cycle retrieved in Step S4 has been measured by the timer 43. Specifically, the cleaning liquid feeding controlling section 25 judges whether the predetermined time corresponding to the cleaning liquid feeding cycle retrieved in Step S4 has elapsed (Step S7). If it is judged that the predetermined time corresponding to the cleaning liquid feeding cycle has elapsed (YES in Step S7), the cleaning liquid feeding controlling section 25 causes the cleaning liquid feeding section 20 to perform a cleaning liquid feeding operation for e.g. 1.5 seconds (Step S8). If, on the other hand, it is judged that the predetermined time corresponding to the cleaning liquid feeding cycle has not elapsed (NO in Step S7), the routine returns to Step S6, and the operations in Steps S6 and S7 are cyclically executed until the image forming operation is completed, or until the predetermined time corresponding to the cleaning liquid feeding cycle is elapsed.

Next, the cleaning liquid feeding controlling section 25 resets the timer 43 (Step S9). Thereafter, the routine returns to Step S3 so that the cleaning liquid feeding controlling section 25 cyclically executes the operations from Step S3 through Step S9 until the image forming operation is completed.

In the first embodiment, the control flow shown in FIG. 6 is used, because the following finding has been obtained based on a prior evaluation result. Specifically, there is no such change in temperature and humidity that requires changing the cleaning liquid feeding cycle until at most 45 seconds lapses as the predetermined time in Step S7. However, in an arrangement in which the temperature and the humidity are changed in such a way that requires changing the cleaning liquid feeding cycle, the routine may return to Step S3, if it is judged that the predetermined time has not elapsed (NO in Step S7 in FIG. 6). In the above modification, in the case where a cleaning liquid feeding cycle retrieved based on a temperature and a humidity detected at a certain point of time is different from a cleaning liquid feeding cycle retrieved based on a temperature and a humidity detected at a point of time earlier than the certain point of time, preferably, the cleaning liquid feeding cycle may be corrected.

Further alternatively, Step S2 may be performed between Step S4 and Step S5. Specifically, in response to receiving a user's command for image formation, the cleaning liquid feeding controlling section 25 acquires temperature information from the temperature sensor 18 and humidity information from the humidity sensor 19. Then, the cleaning liquid feeding controlling section 25 retrieves an allowable amount of water vapor to be evaporated from e.g. the temperature-humidity table T1 as shown in FIG. 4, based on the temperature indicated by the acquired temperature information and the humidity indicated by the acquired humidity information. Then, the cleaning liquid feeding controlling section 25 retrieves a cleaning liquid feeding cycle from e.g. the cleaning liquid feeding cycle table T2 shown in FIG. 5, based on the retrieved allowable amount of water vapor to be evaporated. The cleaning liquid feeding controlling section 25 causes the cleaning liquid feeding section 20 to perform a cleaning liquid feeding operation for e.g. 2 seconds. Thereafter, the controlling section 24 starts driving the transport belt 12, and causes the timer 43 to start measuring a time.

As described above, the image forming apparatus 1 in the first embodiment is configured in such a manner that: cleaning liquid feeding cycles are prestored in association with allowable amounts of water vapor to be evaporated; a cleaning liquid feeding cycle corresponding to an allowable amount of water vapor to be evaporated, which has been retrieved based on a detected ambient temperature and a detected ambient humidity in the interior of the image forming apparatus 1, is retrieved from the stored data i.e. the cleaning liquid feeding cycle table T2; and a cleaning liquid feeding operation is performed at the retrieved cleaning liquid feeding cycle. This arrangement enables to keep the space between the transport belt 12 and the liquid absorbent member 23, and the space between the transport belt 12 and the cleaning blade 13 in a wet state.

As described above, the cleaning liquid feeding operation to be performed by the cleaning liquid feeding controlling section 25 is controlled, based on a condition of the image forming apparatus relating to evaporation of the cleaning liquid. This enables to securely clean the transport belt 12, while preventing or suppressing waste of the cleaning liquid resulting from an excessive feeding of the cleaning liquid, or unstable driving of the transport belt 12 resulting from an increase in frictional force between the liquid absorbent member 23 and the transport belt 12, and frictional force between the cleaning blade 13 and the transport belt 12 due to shortage of the amount of the cleaning liquid to be fed.

In this embodiment, the aforementioned effect is obtained by operating the cleaning liquid feeding controlling section 25 to increase the amount of the cleaning liquid to be fed per unit time, as the difference between the amount of saturated water vapor and the amount of water vapor actually held in the ambient air is increased.

Second Embodiment

Figure 7:
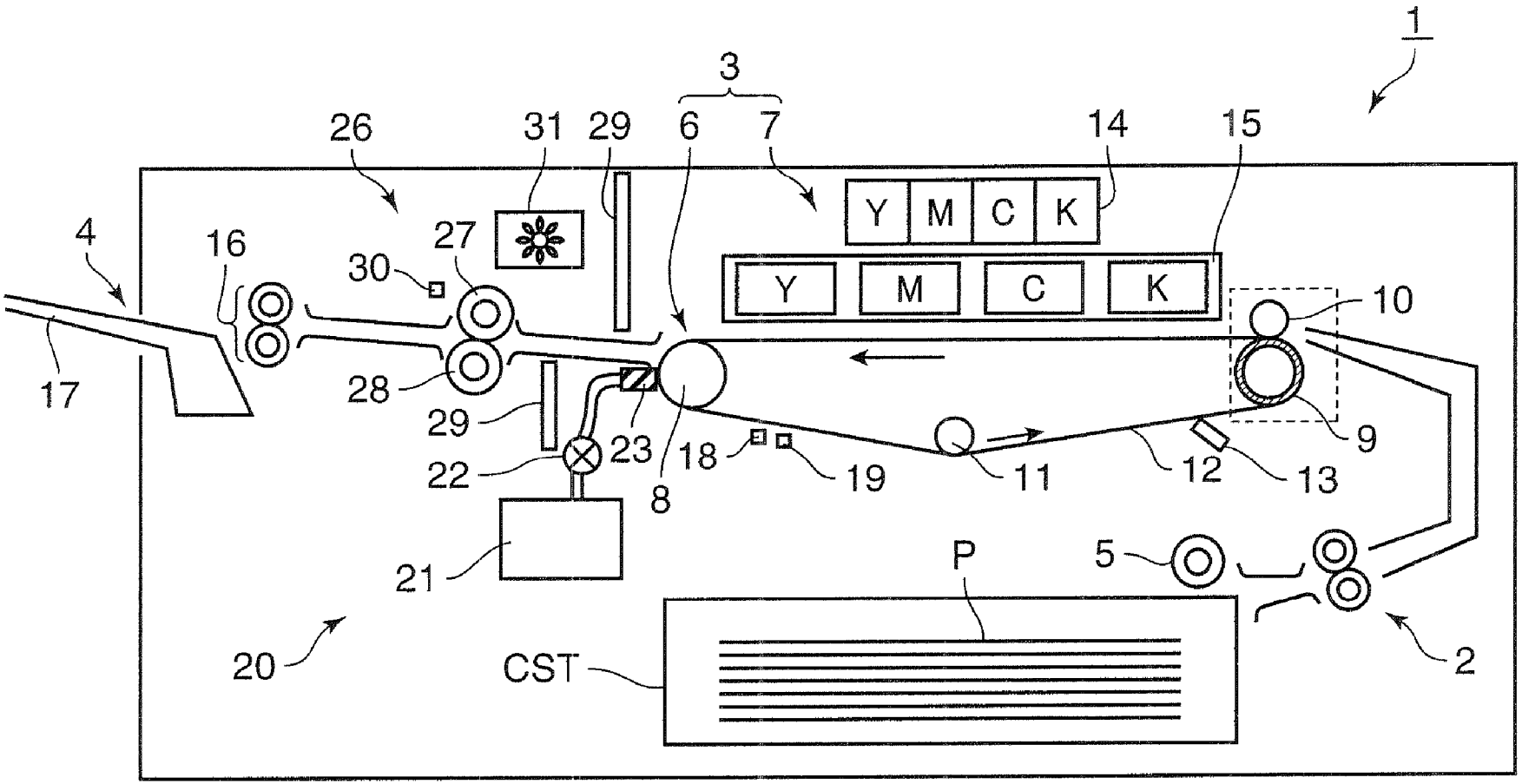
FIG. 7 is a diagram showing an arrangement of an image forming apparatus in accordance with a second embodiment of the invention.

FIG. 7 is a diagram showing an arrangement of an image forming apparatus in accordance with the second embodiment of the invention. The arrangement of the image forming apparatus 1 in the second embodiment is substantially the same as the arrangement of the image forming apparatus 1 in the first embodiment except that the image forming apparatus 1 in the second embodiment is additionally provided with a drying section 26, a heat shielding plate 29, and an air exhaust section 31, which will be described later. Accordingly, like elements in the second embodiment are indicated with like reference numerals, description thereof will be omitted herein, and merely the arrangement of the second embodiment which is different from the arrangement of the first embodiment is described.

As shown in FIG. 7, the image forming apparatus 1 in the second embodiment has the drying section 26 between a drive roller 8 in a sheet transporting section 6, and a sheet discharging section 4. A heat roller 27, a pressure roller 28 and a temperature sensor 30 are provided in the drying section 26. The heat roller 27 and the pressure roller 28 are arranged as opposed to each other in a contacted state. The heat roller 27 and the pressure roller 28 are adapted to dry a sheet transported from the sheet transporting section 6 by heating the sheet while pressing the sheet. The temperature sensor 30 is disposed near the heat roller 27 to detect a surface temperature of the heat roller 27.

The heat shielding plate 29 is a plate-like member for suppressing or blocking transfer of a heat generated by the heat roller 27 in the drying section 26 to an ink ejecting section 7, a liquid absorbent member 23, or the like. In the embodiment shown in FIG. 7, two pieces of the heat shielding plate 29 are disposed between the drying section 26 and the ink ejecting section 7, and between the drying section 26 and the liquid absorbent member 23, respectively.

The air exhaust section 31 is constituted of e.g. a fan. The air exhaust section 31 is configured in such a manner that the air in the interior of the image forming apparatus 1 is exhausted to the outside of the image forming apparatus 1, and the air outside the image forming apparatus 1 is drawn into the interior of the image forming apparatus 1 so as to keep the ambient temperature of the air in the interior of the image forming apparatus 1 from rising due to a heat generated by the heat roller 27 in the drying section 26. The air exhaust section 31 has multiple air exhaust levels. In the second embodiment, the air exhaust section 31 has two air exhaust levels, in other words, a low level where the air exhaust performance is relatively weak, and a high level where the air exhaustion performance is relatively strong.

Figure 8:
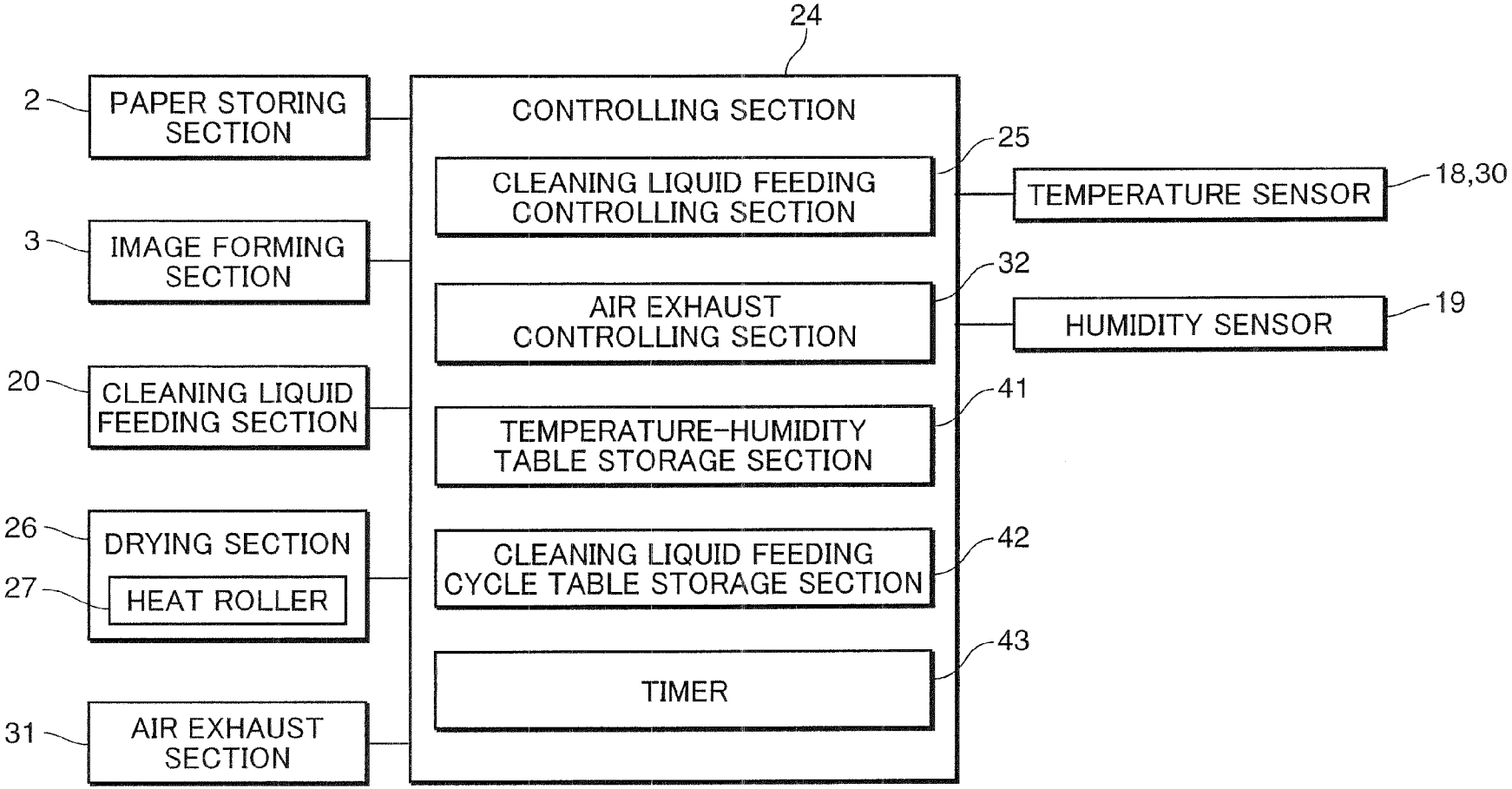
FIG. 8 is a block diagram showing an electrical configuration of the image forming apparatus as the second embodiment of the invention.

FIG. 8 is a block diagram showing an electrical configuration of the image forming apparatus in the second embodiment. As shown in FIG. 8, the image forming apparatus 1 includes a paper storing section 2, an image forming section 3, a cleaning liquid feeding section 20, a drying section 26, an air exhaust section 31, temperature sensors 18 and 30, a humidity sensor 19, and a controlling section 24. The drying section 26 and the air exhaust section 31 shown in FIG. 8 correspond to the drying section 26 and the air exhaust section 31 shown in FIG. 7.

The controlling section 24 functionally includes an air exhaust controlling section 32, in addition to a cleaning liquid feeding controlling section 25, a temperature-humidity table storage section 41, a cleaning liquid feeding cycle table storage section 42, and a timer 43 in the first embodiment. The air exhaust controlling section 32 controls the air exhaust section 31 to perform an air exhaust operation, based on temperature information acquired from the temperature sensor 30 for detecting a surface temperature of the heat roller 27 in the drying section 26. In the second embodiment, the air exhaust controlling section 32 controls the air exhaust section 31 to suspend an air exhaust operation until a temperature indicated by the temperature information acquired from the temperature sensor 30 is larger than a predetermined first threshold value. In the case where the temperature indicated by the temperature information acquired from the temperature sensor 30 lies between the first threshold value, and a second threshold value larger than the first threshold value, the air exhaust controlling section 32 causes the air exhaust section 31 to perform an air exhaust operation at the low level i.e. a first level. In the case where the temperature indicated by the temperature information acquired from the temperature sensor 30 is larger than the second threshold value, the air exhaust controlling section 32 causes the air exhaust section 31 to perform an air exhaust operation at the high level i.e. a second level higher than the first level in air exhaust performance. As will be described later, a range of temperature for heating the heat roller 27 may be predetermined depending on the kind of paper to be used, and the air exhaust controlling section 32 may control the air exhaust section 31 depending on the predetermined range of temperature. Similarly to the first embodiment, the cleaning liquid feeding controlling section 25 controls a pump 22 in the cleaning liquid feeding section 20 to feed a cleaning liquid, based on temperature information acquired from the temperature sensor 18 and humidity information acquired from the humidity sensor 19. The cleaning liquid feeding controlling section 25 in the second embodiment is different from the cleaning liquid feeding controlling section 25 in the first embodiment in that the cleaning liquid feeding controlling section 25 in the second embodiment is operable to change the cleaning liquid feeding cycle depending on an operation status of the air exhaust section 31.

The cleaning liquid feeding cycle table storage section 42 in the second embodiment stores a cleaning liquid feeding cycle table showing a relation between an allowable amount of water vapor to be evaporated, and a time interval at which the cleaning liquid is to be fed from the cleaning liquid feeding section 20, with respect to each of the air exhaust levels. Specifically, the cleaning liquid feeding cycle table storage section 42 stores three tables, i.e. a first cleaning liquid feeding cycle table T2 shown in FIG. 5, a second cleaning liquid feeding cycle table T3 shown in FIG. 9A, and a third cleaning liquid feeding cycle table T4 shown in FIG. 9B. The second cleaning liquid feeding cycle table T3 shown in FIG. 9A is a table to be used in the case where the air exhaust section 31 performs an air exhaust operation at the low level. As compared with the first cleaning liquid feeding cycle table T2 shown in FIG. 5, in the second cleaning liquid feeding cycle table T3 shown in FIG. 9A, the cleaning liquid feeding cycle is set to a small value with respect to the allowable amount of water vapor to be evaporated in each corresponding range.

In the case where the air exhaust section 31 performs an air exhaust operation at the low level, an air flow by the air exhaust operation is generated in the interior of the image forming apparatus 1. Accordingly, the interior of the image forming apparatus 1 is brought to a condition where the cleaning liquid is likely to evaporate from a transport belt 12 or a liquid absorbent member 23, as compared with the case of the first embodiment, wherein the air exhaust section 31 is not provided, and accordingly, an air exhaust operation is not performed. In view of the above, in the second cleaning liquid feeding cycle table T3 shown in FIG. 9A, the cleaning liquid feeding cycle is set to a small value, as compared with the first cleaning liquid cycle table T2 shown in FIG. 5. In the second embodiment, the first cleaning liquid feeding cycle table T2 shown in FIG. 5 is a table to be used in the case where the air exhaustion section 31 suspends an air exhaust operation.

The third cleaning liquid feeding cycle table T4 shown in FIG. 9B is a table to be used in the case where the air exhaust section 31 performs an air exhaust operation at the high level. For the same reason as described above concerning the second cleaning liquid feeding cycle table T3 shown in FIG. 9A, in the third cleaning liquid feeding cycle table T4 shown in FIG. 9B, the cleaning liquid feeding cycle with respect to the allowable amount of water vapor to be evaporated in each corresponding range is set to a small value, as compared with the second cleaning liquid feeding cycle table T3 shown in FIG. 9A.

The cleaning liquid feeding controlling section 25 retrieves, from the temperature-humidity table T1 as shown in FIG. 4, an allowable amount of water vapor to be evaporated corresponding to a temperature detected by the temperature sensor 18 and a humidity detected by the humidity sensor 19; selects one of the first through the third cleaning liquid feeding cycle tables T2 through T4 corresponding to a detected air exhaust level; retrieves, from the selected cleaning liquid feeding cycle table, a time interval corresponding to the retrieved allowable amount of water vapor to be evaporated; and controls the cleaning liquid feeding section 20 to perform a cleaning liquid feeding operation depending on the retrieved time interval.

Figure 10:
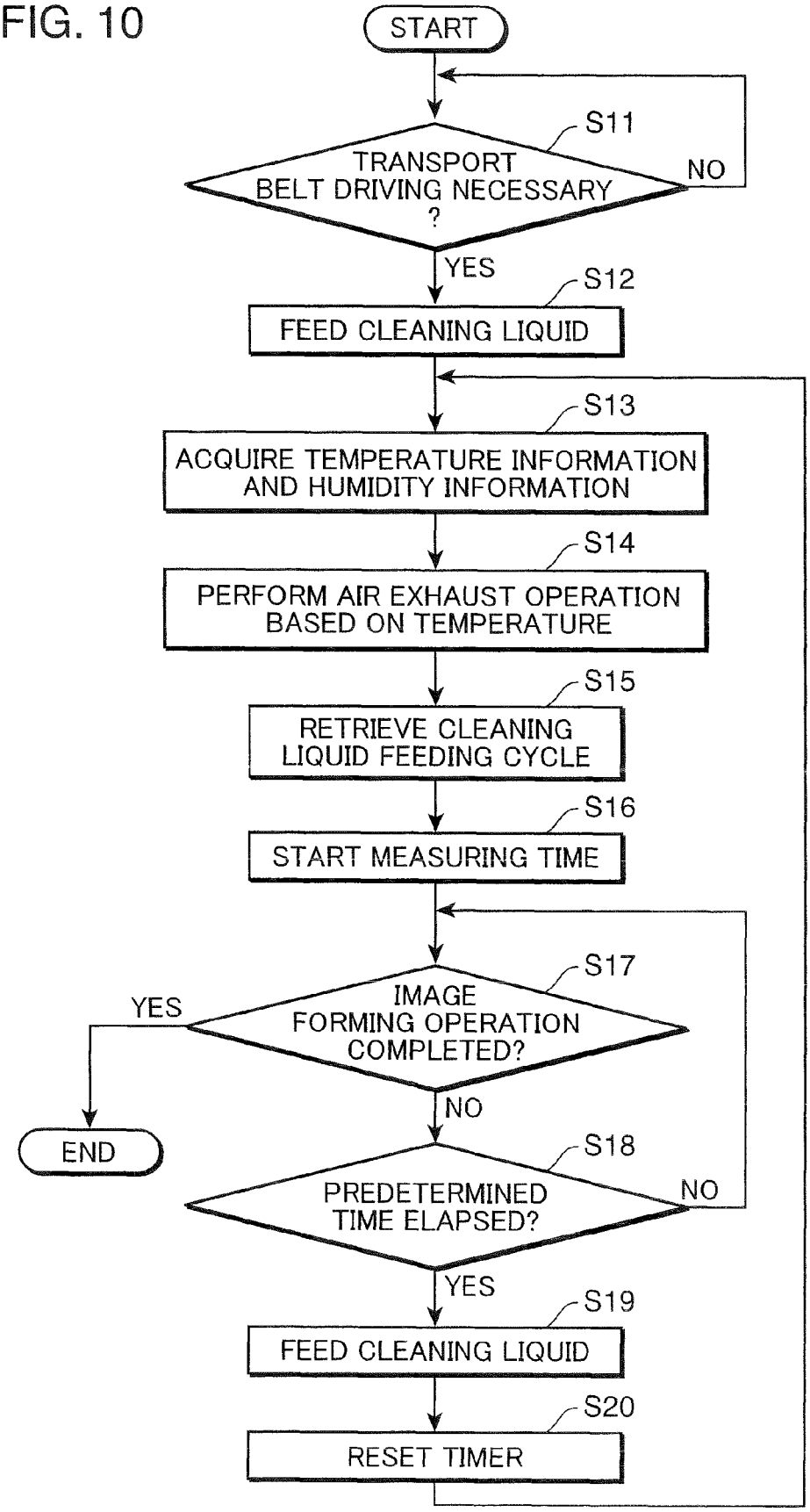
FIG. 10 is a flowchart showing a cleaning liquid feeding control operation to be performed by a cleaning liquid feeding controlling section, and an air exhaust control operation to be performed by an air exhaust controlling section in the second embodiment.

FIG. 10 is a flowchart showing a cleaning liquid feeding control operation to be performed by the cleaning liquid feeding controlling section 25, and an air exhaust control operation to be performed by the air exhaust controlling section 32.

Referring to FIG. 10, first, the controlling section 24 judges whether it is necessary to drive the transport belt 12, based on a user's command for image formation, a checkup operation to be performed when the image forming apparatus 1 is started up, or a like operation (Step S11). If it is judged that driving of the transport belt 12 is necessary (YES in Step S11), the cleaning liquid controlling section 25 causes the cleaning liquid feeding section 20 to perform a cleaning liquid feeding operation for e.g. 2 seconds (Step S12). Thereafter, the controlling section 24 starts driving the transport belt 12. If, on the other hand, it is judged that driving of the transport belt 12 is not necessary (NO in Step S11), the transport belt 12 is brought to a standby state.

Then, the controlling section 24 heats the heat roller 27 to the predetermined range of temperature depending on the kind of paper to be used. An information about the kind of the paper to be used is set to the image forming apparatus 1 by user by using the input section not shown. If the paper to be used is not needed drying, the controlling section 24 does not heat up the heat roller 27. Next, the controlling section 24 checks whether the temperature information from the temperature sensor 30 is in the predetermined range of the temperature. Then, the cleaning liquid feeding controlling section 25 acquires temperature information from the temperature sensor 18, and acquires humidity information from the humidity sensor 19 (Step S13). Then, the air exhaust controlling section 32 controls the air exhaust section 31 to perform an air exhaust operation, based on the predetermined range of the temperature depending on the kind of paper to be used (Step S14).

Then, After the controlling section 24 judges the temperature information from the temperature sensor 30 in the predetermined range of the temperature, the cleaning liquid feeding controlling section 25 retrieves a cleaning liquid feeding cycle, based on an operation status of the air exhaust section 31, a temperature detected by the temperature sensor 18, and a humidity detected by the humidity sensor 19 (Step S15). Specifically, the cleaning liquid feeding controlling section 25 retrieves, from e.g. the temperature-humidity table T1 as shown in FIG. 4, an allowable amount of water vapor to be evaporated, based on a temperature indicated by acquired temperature information and a humidity indicated by acquired humidity information. Then, the cleaning liquid feeding controlling section 25 retrieves, from e.g. one of the first cleaning liquid feeding cycle table T2 shown in FIG. 5, the second cleaning liquid feeding cycle table T3 shown in FIG. 9A, and the third cleaning liquid feeding cycle table T4 shown in FIG. 9B, a cleaning liquid feeding cycle, based on the retrieved allowable amount of water vapor to be evaporated and the operation status of the air exhaust section 31.

For instance, in the case where an air exhaust operation at the high level is performed by the air exhaust section 31, the cleaning liquid feeding controlling section 25 selects the third cleaning liquid feeding cycle table T4 shown in FIG. 9B, from the first cleaning liquid feeding cycle table T2 shown in FIG. 5, the second cleaning liquid feeding cycle table T3 shown in FIG. 9A, and the third cleaning liquid feeding cycle table T4 shown in FIG. 9B. Then, in the case where the allowable amount of water vapor to be evaporated which has been retrieved based on the detected temperature and the detected humidity is 33 ($g/m^3$), the cleaning liquid feeding controlling section 25 retrieves 17 seconds as the cleaning liquid feeding cycle. Then, the cleaning liquid feeding controlling section 25 controls the timer 43 to start measuring a time (Step S16).

Then, the cleaning liquid feeding controlling section 25 judges whether an image forming operation has been completed (Step S17). Completion of an image forming operation in the embodiment means that an electric power supply to an unillustrated drive source for rotating the drive roller 8 so as to drive the transport belt 12 shown in FIG. 7 is suspended. Alternatively, a sensor for detecting a rotation state of the drive roller 8 may be provided, and completion of an image forming operation may be defined by suspending rotation of the drive roller 8. If it is judged that an image forming operation has been completed (YES in Step S17), the series of operations to be performed by the cleaning liquid feeding controlling section 25 is terminated.

If, on the other hand, it is judged that an image forming operation has not been completed (NO in Step S17), the cleaning liquid feeding controlling section 25 judges whether a predetermined time corresponding to the cleaning liquid feeding cycle retrieved in Step S15 has been measured by the timer 43. Specifically, the cleaning liquid feeding controlling section 25 judges whether the predetermined time corresponding to the cleaning liquid feeding cycle retrieved in Step S15 has elapsed (Step S18). If it is judged that the predetermined time corresponding to the cleaning liquid feeding cycle has elapsed (YES in Step S18), the cleaning liquid feeding controlling section 25 causes the cleaning liquid feeding section 20 to perform a cleaning liquid feeding operation for e.g. 1.5 seconds (Step S19). If, on the other hand, it is judged that the predetermined time corresponding to the cleaning liquid feeding cycle has not elapsed (NO in Step S18), the routine returns to Step S17, and the operations in Steps S17 and S18 are cyclically executed until the image forming operation is completed, or until the predetermined time corresponding to the cleaning liquid feeding cycle is elapsed.

Then, the cleaning liquid feeding controlling section 25 resets the timer 43 (Step S20). Thereafter, the routine returns to Step S13 so that the cleaning liquid feeding controlling section 25 cyclically executes the operations from Step S13 through Step S20 until the image forming operation is completed.

As described above, in the second embodiment, the cleaning liquid feeding cycle is changed depending on an operation status of the air exhaust section 31 i.e. activation/non-activation of an air exhaust operation by the air exhaust section 31, and an operation level i.e. high/low level in the case where the air exhaust operation is activated. In this arrangement, even if the air exhaust section 31 is provided in the image forming apparatus 1, a cleaning liquid feeding operation can be properly performed for preventing the surface of the transport belt 12 from drying.

The above arrangement enables to securely clean the transport belt 12, while preventing or suppressing waste of the cleaning liquid resulting from an excessive feeding of the cleaning liquid, or unstable driving of the transport belt 12 resulting from an increase in frictional force between the liquid absorbent member 23 and the transport belt 12, and frictional force between the cleaning blade 13 and the transport belt 12 due to shortage of the amount of the cleaning liquid to be fed.

In this embodiment, the aforementioned effect is obtained by operating the cleaning liquid feeding controlling section 25 to increase the amount of the cleaning liquid to be fed per unit time, as the air exhaust level of the air exhaust section 31 is increased.

Third Embodiment

Figure 11:
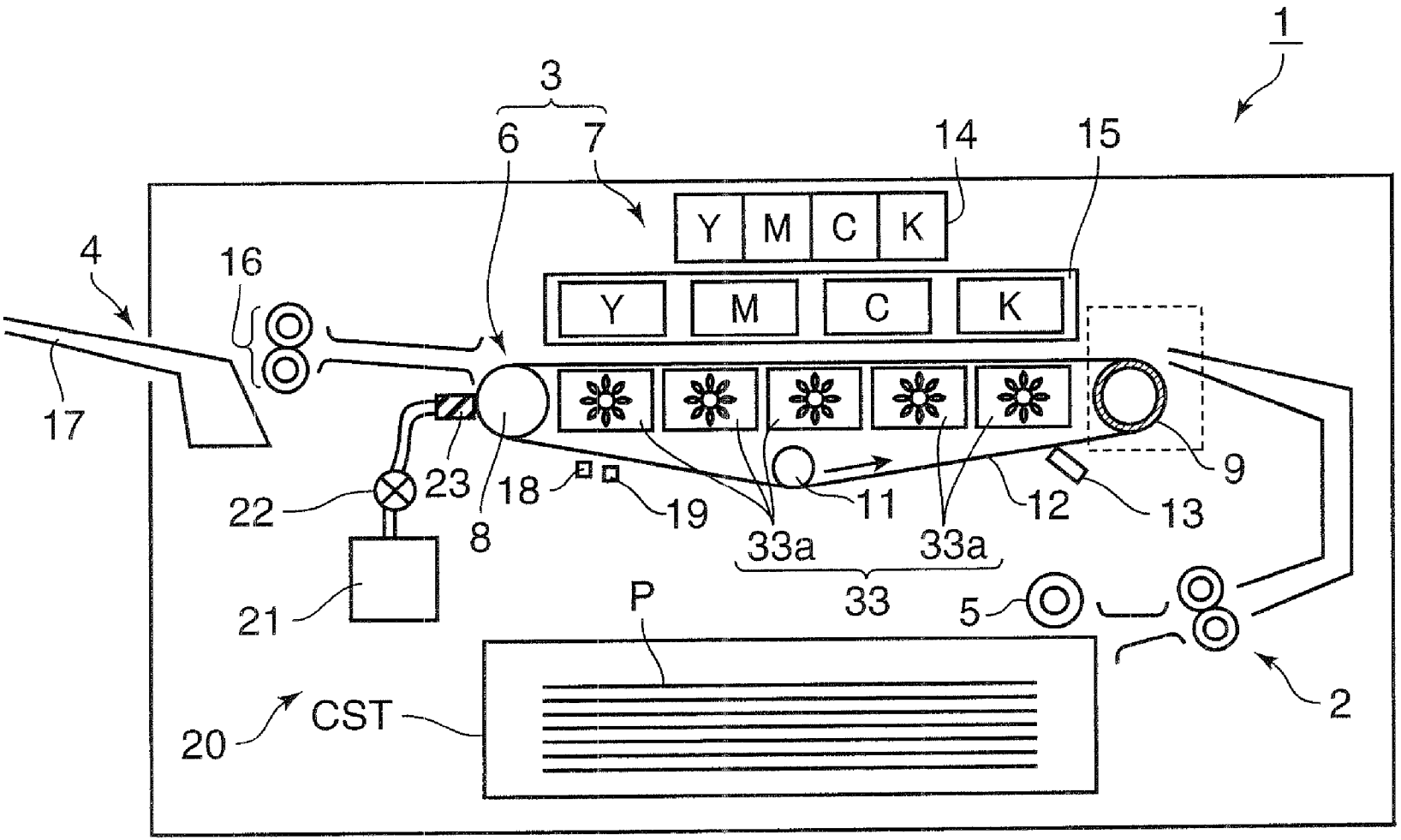
FIG. 11 is a diagram showing an arrangement of an image forming apparatus in accordance with a third embodiment of the invention.

FIG. 11 is a diagram showing an arrangement of an image forming apparatus in accordance with the third embodiment of the invention. Unlike the image forming apparatus 1 in the first embodiment, wherein a sheet is electrostatically attracted to a transport belt by electrical force caused by the suction roller 10, the image forming apparatus 1 in the third embodiment is constructed in such a manner that a sheet is pneumatically attracted to a transport belt 12 by utilizing air suction by an air suction section 33. The image forming apparatus 1 in the third embodiment is substantially the same as the image forming apparatus 1 in the first embodiment except that the image forming apparatus 1 in the third embodiment is additionally provided with the air suction section 33. Accordingly, like elements in the third embodiment are indicated with like reference numerals, description thereof will be omitted herein, and merely the arrangement of the third embodiment which is different from the arrangement of the first embodiment is described.

As shown in FIG. 11, the image forming apparatus 1 in the third embodiment is additionally provided with the air suction section 33 for pneumatically attracting a sheet to the transport belt 12 by utilizing air suction. The air suction section 33 has a plurality of fans 33*a* along a surface opposite to a transport surface of the transport belt 12. The transport belt 12 is formed with multitudes of holes (not shown) through which an air flow caused by the operation of the air suction section 33 can pass. The air suction section 33 is operated in such a manner that a negative pressure force i.e. a suction force is generated on the transport surface by activation of the fans 33*a*, and a sheet being transported along the transport belt 12 is pneumatically attracted to the transport surface of the transport belt 12 by the negative pressure force.

The air suction section 33 has multiple air suction levels. In the third embodiment, the air suction section 33 has two air suction levels, in other words, a low level where the air suction performance is relatively weak, and a high level where the air suction performance is relatively strong. In the case where an image forming operation is performed, if a sheet for image formation is an ordinary sheet, the air suction section 33 performs an air suction operation at the low level i.e. a first level; and if a sheet for image formation is a sheet (hereinafter, called as a "thick sheet") having a relatively large thickness, the air suction section 33 performs an air suction operation at the high level i.e. a second level higher than the first level in air suction performance, considering that it is necessary to pneumatically attract the thick sheet to the transport belt 12 with a relatively large suction force.

Figure 12:
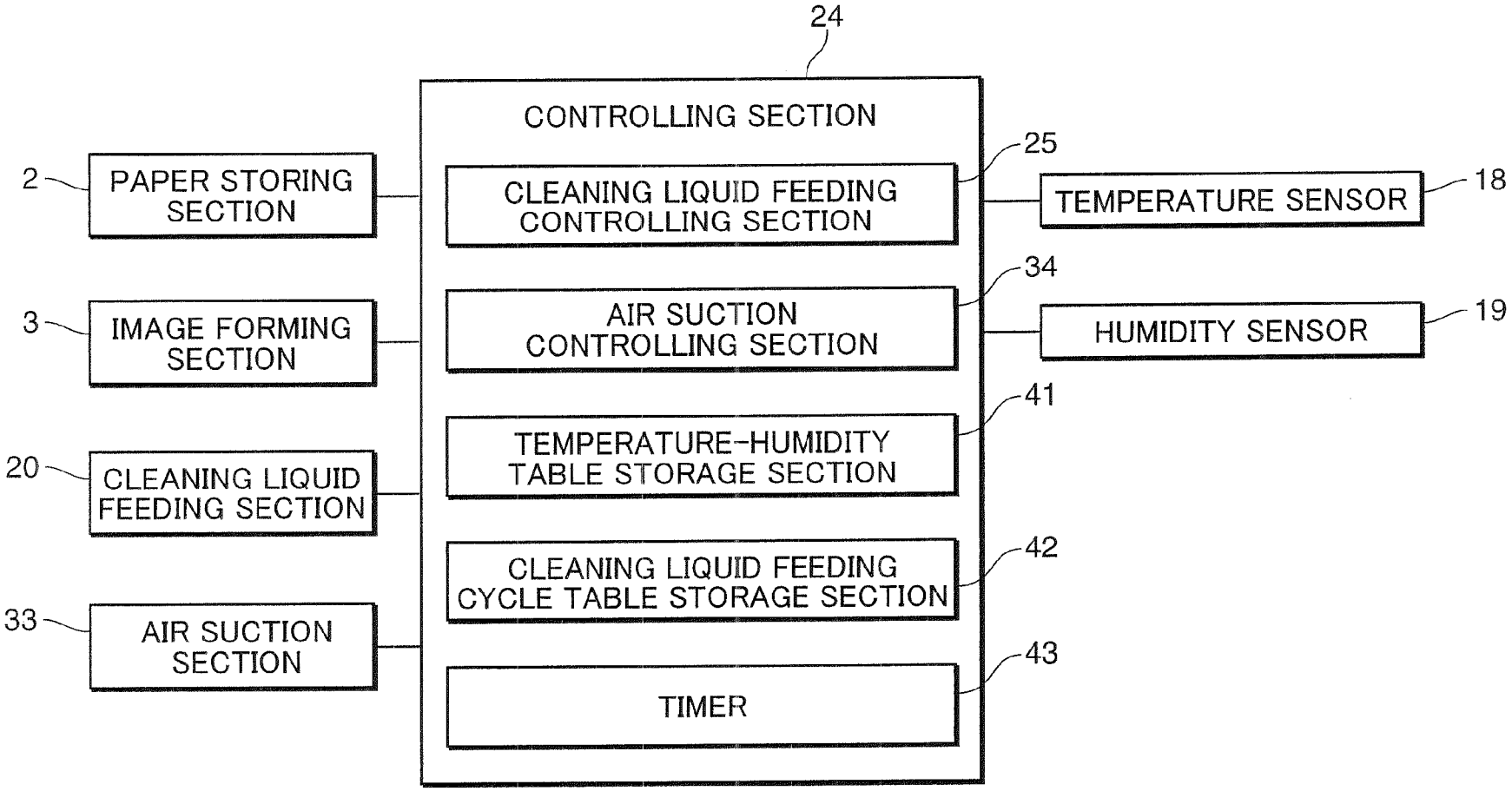
FIG. 12 is a block diagram showing an electrical configuration of the image forming apparatus as the third embodiment of the invention.

FIG. 12 is a block diagram showing an electrical configuration of the image forming apparatus 1 in the third embodiment. As shown in FIG. 12, the image forming apparatus 1 includes a paper storing section 2, an image forming section 3, a cleaning liquid feeding section 20, an air suction section 33, a temperature sensor 18, a humidity sensor 19, and a controlling section 24. The air suction section 33 shown in FIG. 12 corresponds to the air suction section 33 shown in FIG. 11.

The controlling section 24 functionally includes an air suction controlling section 34 for controlling the air suction section 33 to perform an air suction operation, in addition to a cleaning liquid feeding controlling section 25, a temperature-humidity table storage section 41, a cleaning liquid feeding cycle table storage section 42, and a timer 43 corresponding to the cleaning liquid feeding controlling section 25, the temperature-humidity table storage section 41, the cleaning liquid feeding cycle table storage section 42, and the timer 43 in the first embodiment. During an image forming period when an image forming operation is performed by the image forming section 3, if the image forming operation is performed with respect to an ordinary sheet, the air suction controlling section 34 controls the air suction section 33 to perform an air suction operation at the low level; and if the image forming operation is performed with respect to a thick sheet, the air suction controlling section 34 controls the air suction section 33 to perform an air suction operation at the high level. Also, the air suction controlling section 34 controls the air suction section 33 to suspend an air suction operation during a period other than the image forming period. Judgment as to whether a sheet for image formation is an ordinary sheet or a thick sheet is made based on operation information to be inputted by a user through an unillustrated operation section. In other words, the operation section is operable to accept input indicating the kind of sheet for image formation.

Similarly to the first embodiment, the cleaning liquid feeding controlling section 25 controls a pump 22 in the cleaning liquid feeding section 20 to feed a cleaning liquid, based on temperature information acquired from the temperature sensor 18 and humidity information acquired from the humidity sensor 19. The cleaning liquid feeding controlling section 25 in the third embodiment is different from the cleaning liquid feeding controlling section 25 in the first embodiment in that a cleaning liquid feeding cycle in the third embodiment is changed depending on an operation status of the air suction section 33.

The cleaning liquid feeding cycle table storage section 42 in the third embodiment stores a cleaning liquid feeding cycle table showing a relation between an allowable amount of water vapor to be evaporated, and a time interval at which the cleaning liquid is to be fed from the cleaning liquid feeding section 20, with respect to each of the air suction levels. Specifically, similarly to the second embodiment, the cleaning liquid feeding cycle table storage section 42 stores e.g. the second cleaning liquid feeding cycle table T3 shown in FIG. 9A, and the third cleaning liquid feeding cycle table T4 shown in FIG. 9B. The second cleaning liquid feeding cycle table T3 shown in FIG. 9A is a table to be used in the case where the air suction section 33 performs an air suction operation at the low level. As compared with the first cleaning liquid feeding cycle table T2 shown in FIG. 5, in the second cleaning liquid feeding cycle table T3 shown in FIG. 9A, the cleaning liquid feeding cycle is set to a small value with respect to the allowable amount of water vapor to be evaporated in each corresponding range.

In the case where the air suction section 33 performs an air suction operation, an air flow by the air suction operation is generated in the interior of the image forming apparatus 1. Accordingly, the interior of the image forming apparatus 1 is brought to a condition that a cleaning liquid is likely to evaporate from the transport belt 12 or a liquid absorbent member 23, as compared with the case of the first embodiment, wherein the air suction section 33 is not provided, and accordingly, an air suction operation is not performed. In view of the above, in the second cleaning liquid feeding cycle table T3 shown in FIG. 9A, the cleaning liquid feeding cycle is set to a small value, as compared with the first cleaning liquid feeding cycle table T2 shown in FIG. 5.

The third cleaning liquid feeding cycle table T4 shown in FIG. 9B is a table to be used in the case where the air suction section 33 performs an air suction operation at the high level. For the same reason as described above concerning the second cleaning liquid feeding cycle table T3 shown in FIG. 9A, in the third cleaning liquid feeding cycle table T4 shown in FIG. 9B, the cleaning liquid feeding cycle with respect to the allowable amount of water vapor to be evaporated in each corresponding range is set to a small value, as compared with the second cleaning liquid feeding cycle table T3 shown in FIG. 9A.

The cleaning liquid feeding controlling section 25 retrieves, from the temperature-humidity table T1 as shown in FIG. 4, an allowable amount of water vapor to be evaporated corresponding to a temperature detected by the temperature sensor 18 and a humidity detected by the humidity sensor 19; selects one of the second cleaning liquid feeding cycle table T3 and the third cleaning liquid feeding cycle table T4 corresponding to an operating air suction level; retrieves, from the selected cleaning liquid feeding cycle table, a time interval corresponding to the retrieved allowable amount of water vapor to be evaporated; and controls the cleaning liquid feeding section 20 to perform a cleaning liquid feeding operation at the retrieved time interval.

Figure 13:
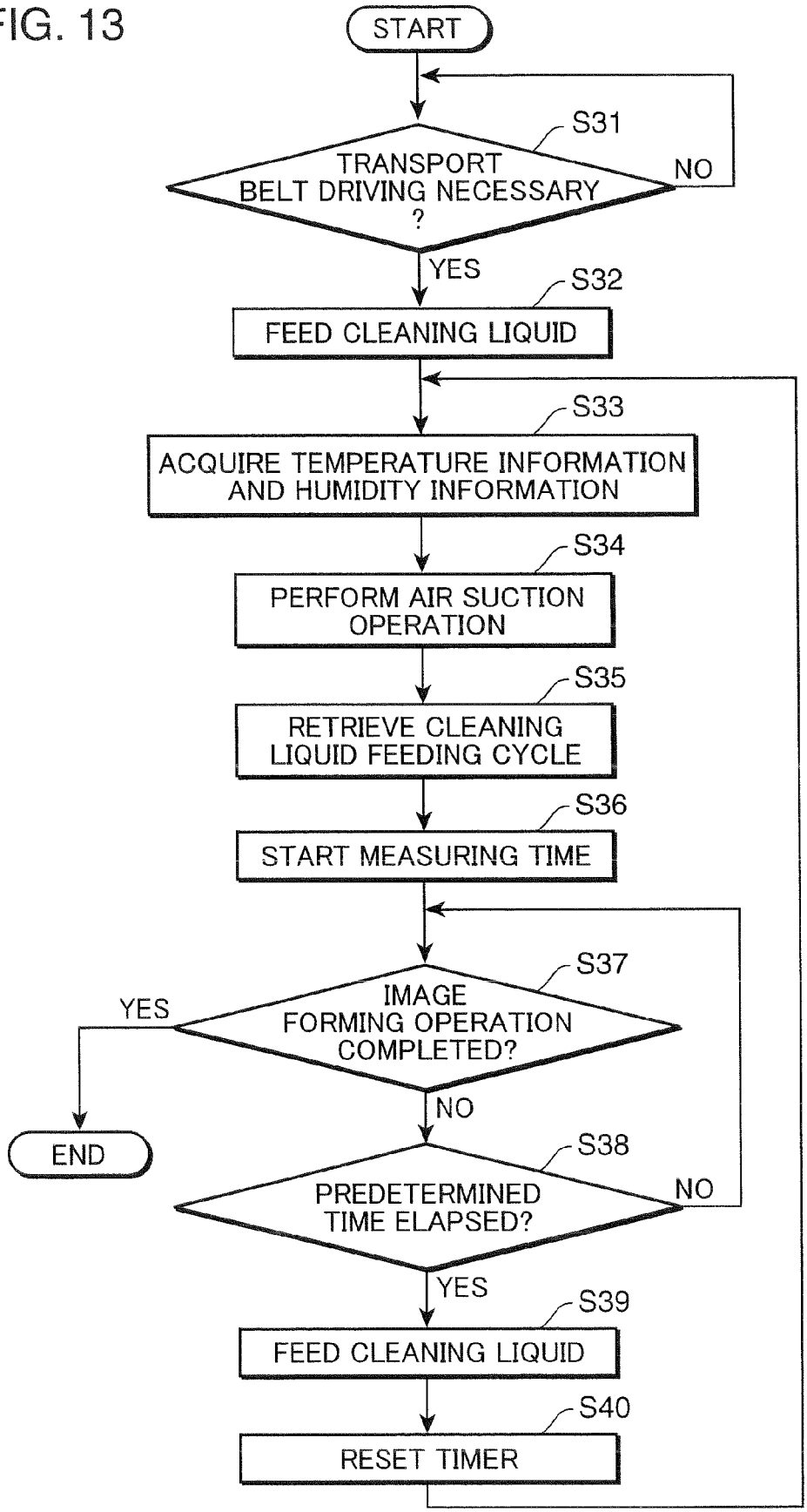
FIG. 13 is a flowchart showing a cleaning liquid feeding control operation to be performed by a cleaning liquid feeding controlling section, and an air suction control operation to be performed by an air suction controlling section in the third embodiment.

FIG. 13 is a flowchart showing a cleaning liquid feeding control operation to be performed by the cleaning liquid feeding controlling section 25, and an air suction control operation to be performed by the air suction controlling section 34.

Referring to FIG. 13, first, the controlling section 24 judges whether it is necessary to drive the transport belt 12, based on a user's command for image formation, a checkup operation to be performed when the image forming apparatus 1 is started up, or a like operation (Step S31). If it is judged that driving of the transport belt 12 is necessary (YES in Step S31), the cleaning liquid controlling section 25 causes the cleaning liquid feeding section 20 to perform a cleaning liquid feeding operation for e.g. 2 seconds (Step S32). Thereafter, the controlling section 24 starts driving the transport belt 12. If, on the other hand, it is judged that driving of the transport belt 12 is not necessary (NO in Step S31), the transport belt 12 is brought to a standby state.

Then, the cleaning liquid feeding controlling section 25 acquires temperature information from the temperature sensor 18, and acquires humidity information from the humidity sensor 19 (Step S33). Then, the air suction controlling section 34 controls the air suction section 33 to perform an air suction operation at an air suction level corresponding to the kind of sheet for image formation (Step S34).

Then, the cleaning liquid feeding controlling section 25 retrieves a cleaning liquid feeding cycle, based on an operation status of the air suction section 33, a temperature detected by the temperature sensor 18, and a humidity detected by the humidity sensor 19 (Step S35). Specifically, the cleaning liquid feeding controlling section 25 retrieves, from e.g. the temperature-humidity table T1 as shown in FIG. 4, an allowable amount of water vapor to be evaporated, based on a temperature indicated by acquired temperature information and a humidity indicated by acquired humidity information. Then, the cleaning liquid feeding controlling section 25 retrieves, from e.g. one of the second cleaning liquid feeding cycle table T3 shown in FIG. 9A and the third cleaning liquid feeding cycle table T4 shown in FIG. 9B, a cleaning liquid feeding cycle, based on the retrieved allowable amount of water vapor to be evaporated and the operation status of the air suction section 33.

For instance, in the case where an air suction operation at the high level is performed by the air suction section 33, the cleaning liquid feeding controlling section 25 selects the table T4, from the table T3 and the table T4. Then, in the case where the allowable amount of water vapor to be evaporated, which has been retrieved based on the detected temperature and the detected humidity is 33 ($g/m^3$), the cleaning liquid feeding controlling section 25 retrieves 17 seconds as the cleaning liquid feeding cycle. Then, the cleaning liquid feeding controlling section 25 controls the timer 43 to start measuring a time (Step S36).

Then, the cleaning liquid feeding controlling section 25 judges whether an image forming operation has been completed (Step S37). Completion of an image forming operation in the embodiment means that an electric power supply to an unillustrated drive source for rotating a drive roller 8 to drive the transport belt 12 shown in FIG. 11 is suspended. Alternatively, a sensor for detecting rotation of the drive roller 8 may be provided, and completion of an image forming operation may be defined by suspending rotation of the drive roller 8. If it is judged that an image forming operation has been completed (YES in Step S37), the series of operations to be performed by the cleaning liquid feeding controlling section 25 is terminated.

If, on the other hand, it is judged that an image forming operation has not been completed (NO in Step S37), the cleaning liquid feeding controlling section 25 judges whether a predetermined time corresponding to the cleaning liquid feeding cycle retrieved in Step S35 has been measured by the timer 43. Specifically, the cleaning liquid feeding controlling section 25 judges whether the predetermined time corresponding to the cleaning liquid feeding cycle retrieved in Step S35 has elapsed (Step S38). If it is judged that the predetermined time corresponding to the cleaning liquid feeding cycle has elapsed (YES in Step S38), the cleaning liquid feeding controlling section 25 causes the cleaning liquid feeding section 20 to perform a cleaning liquid feeding operation for e.g. 1.5 seconds (Step S39). If, on the other hand, it is judged that the predetermined time corresponding to the cleaning liquid feeding cycle has not elapsed (NO in Step S38), the routine returns to Step S37, and the operations in Step S37 and Step S38 are cyclically executed until the image forming operation is completed, or the predetermined time corresponding to the cleaning liquid feeding cycle is elapsed.

Next, the cleaning liquid feeding controlling section 25 resets the timer 43 (Step S40). Thereafter, the routine returns to Step S33 so that the cleaning liquid feeding controlling section 25 cyclically executes the operations from Step S33 through Step S40 until the image forming operation is completed.

As described above, in the third embodiment, the cleaning liquid feeding cycle is changed depending on an operation status of the air suction section 33, in other words, an operation level i.e. an air suction level of the air suction operation to be performed by the air suction section 33. Accordingly, even if the air suction section 33 is provided in the image forming apparatus 1, a cleaning liquid feeding operation can be properly performed for preventing the surface of the transport belt 12 from drying.

The above arrangement enables to securely clean the transport belt 12, while preventing or suppressing waste of the cleaning liquid resulting from an excessive feeding of the cleaning liquid, or unstable driving of the transport belt 12 resulting from an increase in frictional force between the liquid absorbent member 23 and the transport belt 12, and frictional force between the cleaning blade 13 and the transport belt 12 due to shortage of the amount of the cleaning liquid to be fed.

In this embodiment, the aforementioned effect is obtained by operating the cleaning liquid feeding controlling section 25 to increase the amount of the cleaning liquid to be fed per unit time, as the air suction level of the air suction section 33 is increased.

Fourth Embodiment

Figure 14:
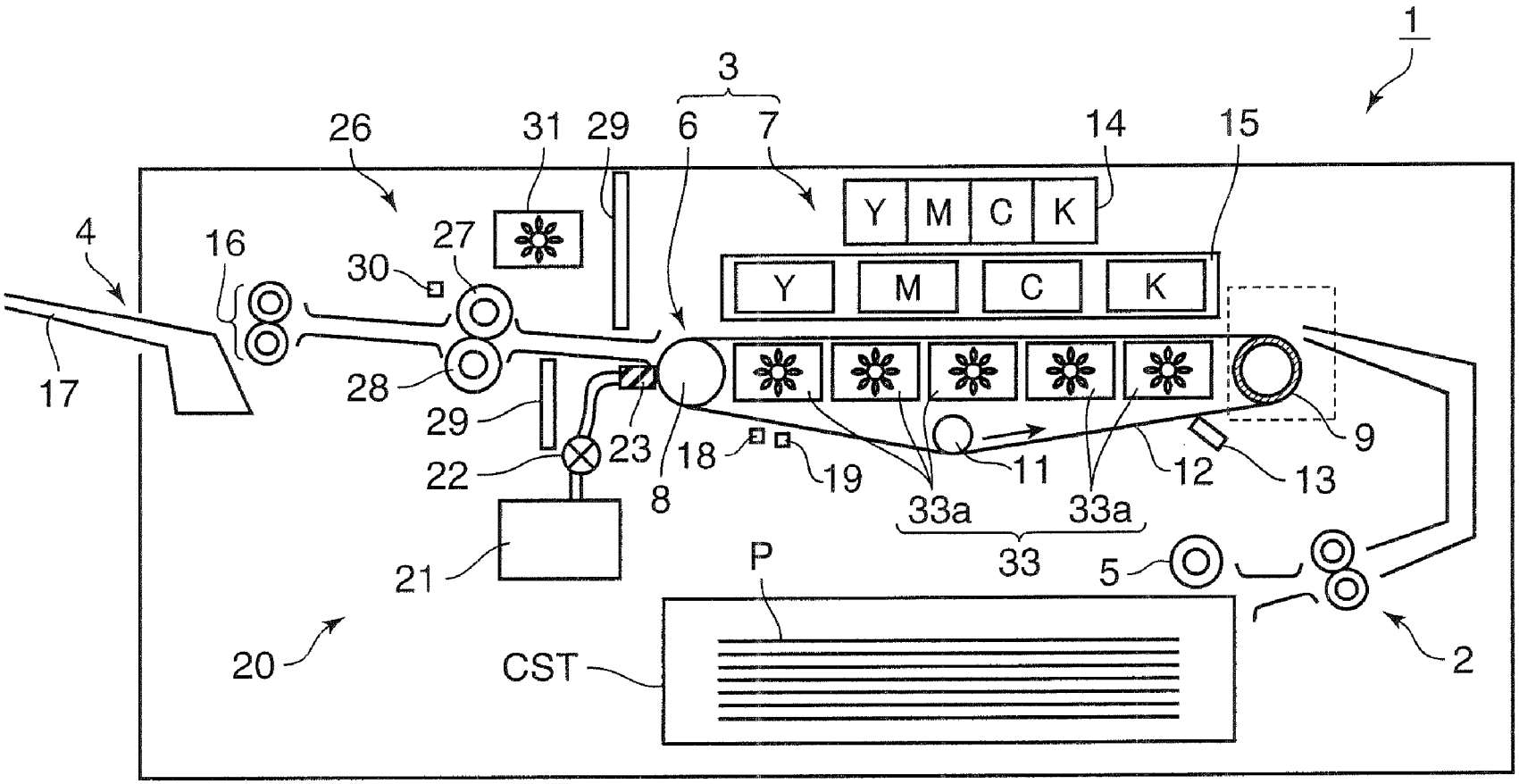
FIG. 14 is a diagram showing an arrangement of an image forming apparatus in accordance with a fourth embodiment of the invention.
Figure 15:
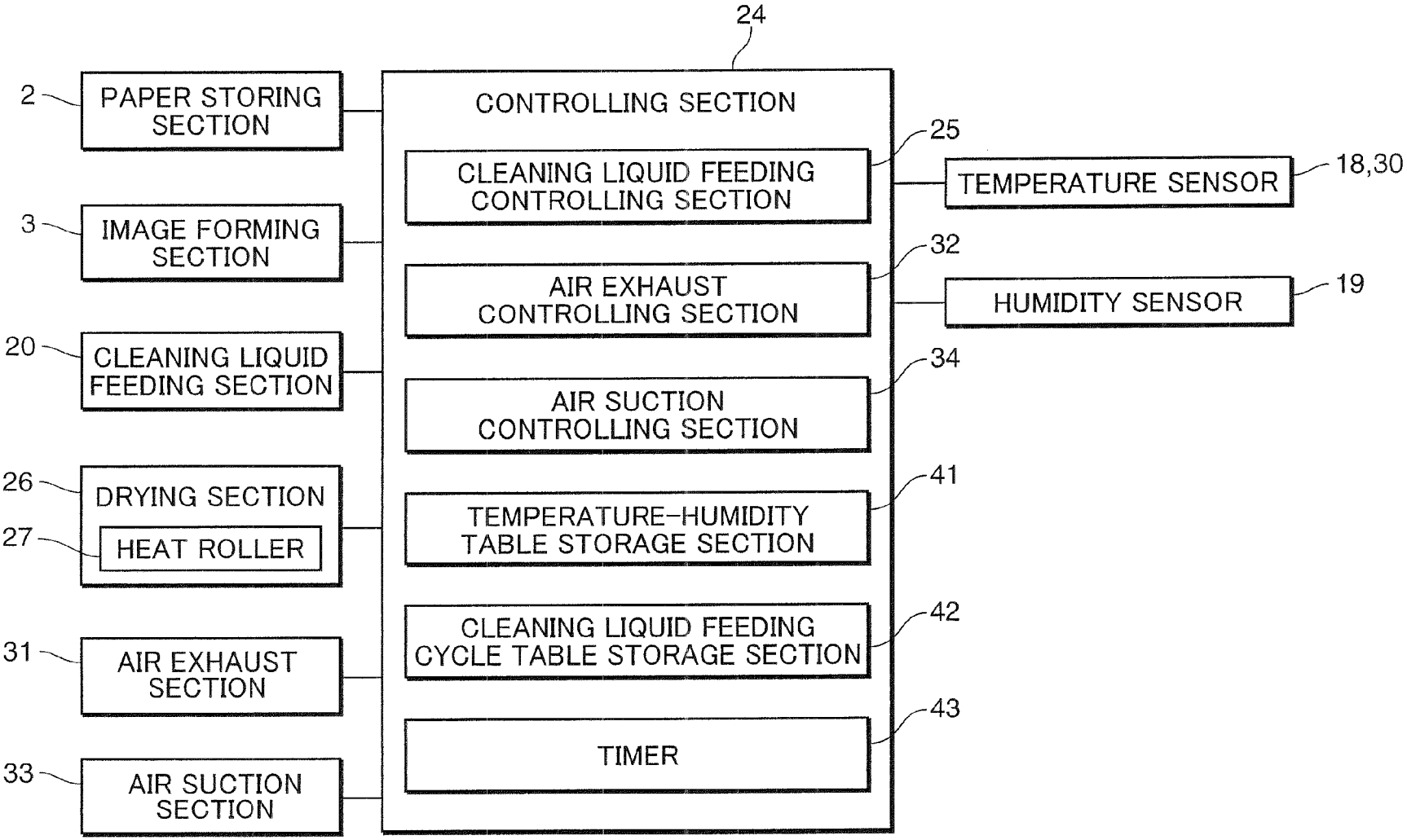
FIG. 15 is a block diagram showing an electrical configuration of the image forming apparatus as the fourth embodiment of the invention.

FIG. 14 is a diagram showing an arrangement of an image forming apparatus in accordance with the fourth embodiment of the invention. FIG. 15 is a block diagram showing an electrical configuration of the image forming apparatus 1 in the fourth embodiment. As shown in FIGS. 14 and 15, the image forming apparatus 1 in the fourth embodiment is a combination of the image forming apparatus 1 in the second embodiment and the image forming apparatus 1 in the third embodiment. Specifically, the image forming apparatus 1 in the fourth embodiment is provided with a drying section 26, a heat shielding plate 29, a temperature sensor 30, an air exhaust section 31, an air suction section 33, an air exhaust controlling section 32, and an air suction controlling section 34, in addition to elements corresponding to the elements in the first embodiment. A cleaning liquid feeding controlling section 25 is operable to change a cleaning liquid feeding cycle depending on an operation status of the air exhaust section 31 and an operation status of the air suction section 33.

A cleaning liquid feeding cycle table storage section 42 in the fourth embodiment stores a cleaning liquid feeding cycle table showing a relation between an allowable amount of water vapor to be evaporated, and a time interval at which the cleaning liquid is to be fed from the cleaning liquid feeding section 20, with respect to each of combinations of air exhaust levels and air suction levels. Specifically, the cleaning liquid feeding cycle table storage section 42 stores e.g. a fourth cleaning liquid feeding cycle table T5 shown in FIG. 16A, a fifth cleaning liquid feeding cycle table T6 shown in FIG. 16B, and a sixth cleaning liquid feeding cycle table T7 shown in FIG. 16C, in addition to the second cleaning liquid feeding cycle table T3 shown in FIG. 9A and the third cleaning liquid feeding cycle table T4 shown in FIG. 9B.

The fourth cleaning liquid feeding cycle table T5 shown in FIG. 16A is a table to be used in the case where the air exhaust section 31 performs an air exhaust operation at the low level, and the air suction section 33 performs an air suction operation at the high level. The fifth cleaning liquid feeding cycle table T6 shown in FIG. 16B is a table to be used in the case where the air exhaust section 31 performs an air exhaust operation at the high level, and the air suction section 33 performs an air suction operation at the low level. The sixth cleaning liquid feeding cycle table T7 shown in FIG. 16C is a table to be used in the case where the air exhaust section 31 performs an air exhaust operation at the high level, and the air suction section 33 performs an air suction operation at the high level. In the case where the air exhaust section 31 performs an air exhaust operation at the low level, and the air suction section 33 performs an air suction operation at the low level, the cleaning liquid feeding controlling section 25 uses the third cleaning liquid feeding cycle table T4 shown in FIG. 9B. In the case where the air exhaust section 31 suspends an air exhaust operation, and the air suction section 33 performs an air suction operation at the low level, the cleaning liquid feeding controlling section 25 uses the second cleaning liquid feeding cycle table T3 shown in FIG. 9A. In the case where the air exhaust section 31 suspends an air exhaust operation, and the air suction section 33 performs an air suction operation at the high level, the cleaning liquid feeding controlling section 25 uses the third cleaning liquid feeding cycle table T4 shown in FIG. 9B.

Comparing the second and the third cleaning liquid feeding cycle tables T3 and T4 shown in FIGS. 9A and 9B, and the fourth through the sixth cleaning liquid feeding cycle tables T5 through T7 shown in FIG. 16A through FIG. 16C, the cleaning liquid feeding cycle with respect to the allowable amount of water vapor to be evaporated in each corresponding range is set to a smaller value in the fourth through the sixth cleaning liquid feeding cycle tables T5 through T7 shown in FIG. 16A through FIG. 16C, as compared with the second and the third cleaning liquid feeding cycle tables T3 and T4 shown in FIGS. 9A and 9B. Also, the cleaning liquid feeding cycle with respect to the allowable amount of water vapor to be evaporated in the sixth cleaning liquid feeding cycle table T7 shown in FIG. 16C is set to a smaller value, as compared with the cleaning liquid feeding cycles in the fourth cleaning liquid feeding cycle table T5 shown in FIG. 16A and the fifth cleaning liquid feeding cycle table T6 shown in FIG. 16B, considering that use of the sixth cleaning liquid feeding cycle table T7 shown in FIG. 16C corresponds to a condition that the cleaning liquid is likely to evaporate from a transport belt 12 or a liquid absorbent member 23, as compared with conditions corresponding to use of the fourth cleaning liquid feeding cycle table T5 shown in FIG. 16A and the fifth cleaning liquid feeding cycle table T6 shown in FIG. 16B.

The cleaning liquid feeding controlling section 25 retrieves, from the temperature-humidity table T1 as shown in FIG. 4, an allowable amount of water vapor to be evaporated corresponding to a temperature detected by a temperature sensor 18 and a humidity detected by a humidity sensor 19; selects one of the second through the sixth cleaning liquid feeding cycle tables T3 through T7 corresponding to a combination of an executing air exhaust level and an executing air suction level; retrieves, from the selected cleaning liquid feeding cycle table, a time interval corresponding to the retrieved allowable amount of water vapor to be evaporated; and controls the cleaning liquid feeding section 20 to perform a cleaning liquid feeding operation at the retrieved time interval.

Specifically, the cleaning liquid feeding controlling section 25 retrieves a cleaning liquid feeding cycle, based on an operation status of the air exhaust section 31, an operation status of the air suction section 33, a temperature detected by the temperature sensor 18, and a humidity detected by the humidity sensor 19. In other words, the cleaning liquid feeding controlling section 25 retrieves, from e.g. the temperature-humidity table T1 as shown in FIG. 4, an allowable amount of water vapor to be evaporated, based on a temperature indicated by acquired temperature information and a humidity indicated by acquired humidity information. Then, the cleaning liquid feeding controlling section 25 retrieves, from e.g. one of the second through the sixth cleaning liquid feeding cycle tables T3 through T7 shown in FIGS. 9A, 9B, 16A, 16B, and 16C, a cleaning liquid feeding cycle, based on the retrieved allowable amount of water vapor to be evaporated, the operation status of the air exhaust section 31, and the operation status of the air suction section 33.

For instance, in the case where the air exhaust section 31 suspends an air exhaust operation, and the air suction section 33 performs an air suction operation at the low level, the cleaning liquid feeding controlling section 25 selects the second cleaning liquid feeding cycle table T3 shown in FIG. 9A. In the case where the air exhaust section 31 suspends an air exhaust operation, and the air suction section 33 performs an air suction operation at the high level, the cleaning liquid feeding controlling section 25 selects the third cleaning liquid feeding cycle table T4 shown in FIG. 9B.

In the case where the air exhaust section 31 performs an air exhaust operation at the low level, and the air suction section 33 performs an air suction operation at the high level, the cleaning liquid feeding controlling section 25 selects the fourth cleaning liquid feeding cycle table T5 shown in FIG. 16A. In the case where the air exhaust section 31 performs an air exhaust operation at the high level, and the air suction section 33 performs an air suction operation at the low level, the cleaning liquid feeding controlling section 25 selects the fifth cleaning liquid feeding cycle table T6 shown in FIG. 16B. In the case where the air exhaust section 31 performs an air exhaust operation at the high level, and the air suction section 33 performs an air suction operation at the high level, the cleaning liquid feeding controlling section 25 selects the sixth cleaning liquid feeding cycle table T7 shown in FIG. 16C. In the case where the air exhaust section 31 performs an air exhaust operation at the low level, and the air suction section 33 performs an air suction operation at the low level, the cleaning liquid feeding controlling section 25 selects the third cleaning liquid feeding cycle table T4 shown in FIG. 9B.

Then, the cleaning liquid feeding controlling section 25 retrieves a cleaning liquid feeding cycle corresponding to the retrieved allowable amount of water vapor to be evaporated, by referring to the selected cleaning liquid feeding cycle table.

As described above, even if the air exhaust section 31 and the air suction section 33 are provided in the image forming apparatus 1, a cleaning liquid feeding operation can be properly performed for preventing the surface of the transport belt 12 from drying by changing the cleaning liquid feeding cycle depending on an operation status of the air exhaust section 31 and an operation status of the air suction section 33.

The above arrangement enables to securely clean the transport belt 12, while preventing or suppressing waste of the cleaning liquid resulting from an excessive feeding of the cleaning liquid, or unstable driving of the transport belt 12 resulting from an increase in frictional force between the liquid absorbent member 23 and the transport belt 12, and frictional force between the cleaning blade 13 and the transport belt 12 due to shortage of the amount of the cleaning liquid to be fed.

Fifth Embodiment

Figure 17:
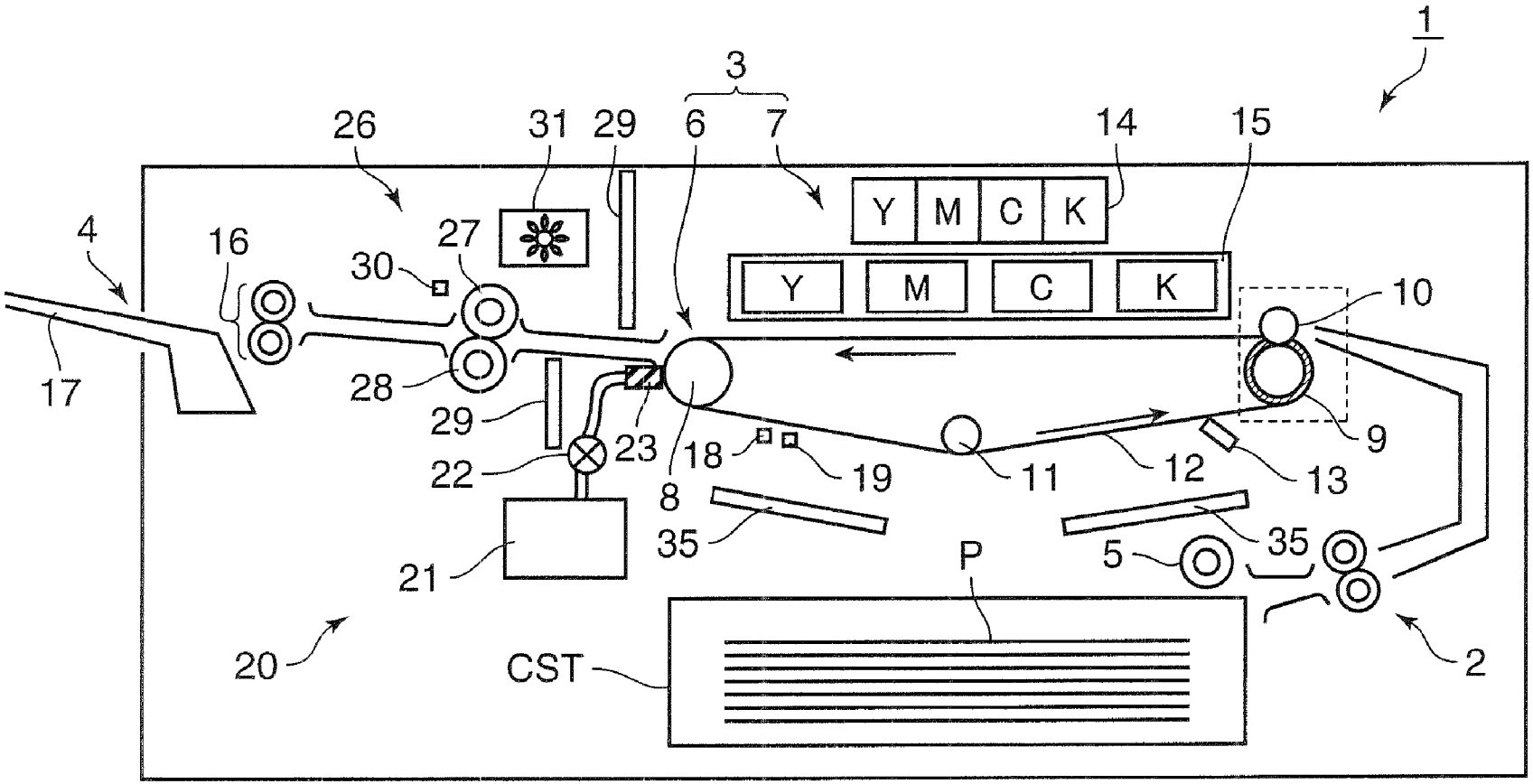
FIG. 17 is a diagram showing an arrangement of an image forming apparatus in accordance with a fifth embodiment of the invention.

FIG. 17 is a diagram showing an arrangement of an image forming apparatus in accordance with the fifth embodiment of the invention. The image forming apparatus 1 in the fifth embodiment includes a temperature adjusting section to be described later, in addition to elements corresponding to the elements in the second embodiment. Accordingly, like elements in the fifth embodiment are indicated with like reference numerals, description thereof will be omitted herein, and merely the arrangement of the fifth embodiment which is different from the arrangement of the second embodiment is described.

The temperature adjusting section 35 is operable to adjust the ambient temperature in the interior of the image forming apparatus 1 to a predetermined temperature e.g. 45° C. so as to suppress a change in viscosity of an ink resulting from a change in the ambient temperature in the interior of the image forming apparatus 1 and keep the viscosity in a proper range.

Figure 18:
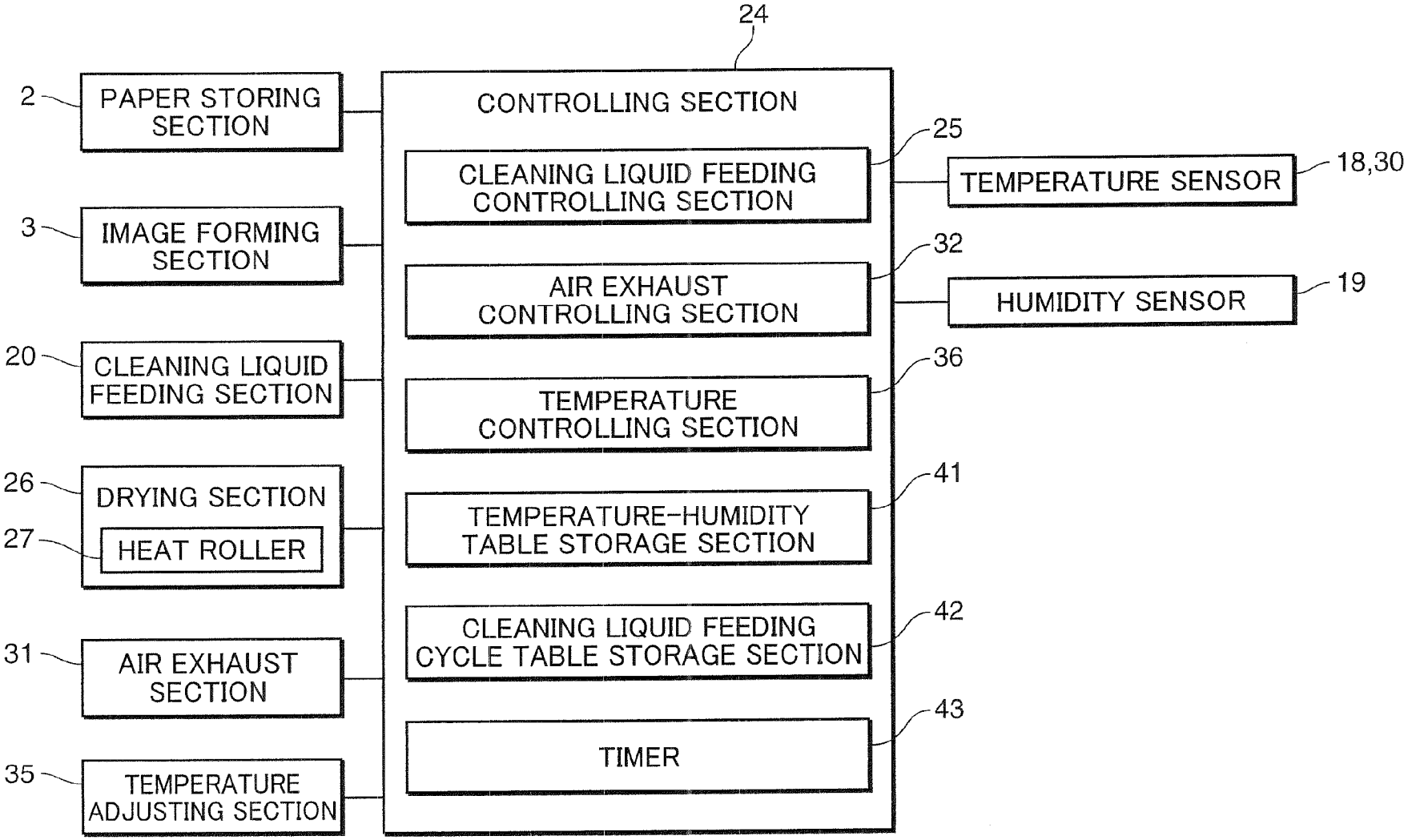
FIG. 18 is a block diagram showing an electrical configuration of the image forming apparatus as the fifth embodiment of the invention.

FIG. 18 is a block diagram showing an electrical configuration of the image forming apparatus 1 in the fifth embodiment of the invention. As shown in FIG. 18, a controlling section 24 functionally includes a temperature controlling section 36, in addition to a cleaning liquid feeding controlling section 25, an air exhaust controlling section 32, a temperature-humidity table storage section 41, a cleaning liquid feeding cycle table storage section 42, and a timer 43 corresponding to the cleaning liquid feeding controlling section 25, the air exhaust controlling section 32, the temperature-humidity table storage section 41, the cleaning liquid feeding cycle table storage section 42, and the timer 43 in the second embodiment. The temperature controlling section 36 controls the temperature adjusting section 35 to perform a temperature adjusting operation, based on a temperature indicated by temperature information acquired from a temperature sensor 18. The temperature adjusting section 35 is built-in with a panel heater (not shown).

The cleaning liquid feeding cycle table storage section 42 in the fifth embodiment stores a cleaning liquid feeding cycle table showing a relation between an allowable amount of water vapor to be evaporated, and a time interval at which a cleaning liquid is to be fed from a cleaning liquid feeding section 20, with respect to each of combinations of air exhaust levels, and temperatures to be adjusted by the temperature adjusting section 35.

The cleaning liquid feeding controlling section 25 retrieves, from the temperature-humidity table T1 as shown in FIG. 4, an allowable amount of water vapor to be evaporated corresponding to a temperature detected by the temperature sensor 18 and a humidity detected by a humidity sensor 19; selects one of the second and the third cleaning liquid feeding cycle tables T3 and T4 corresponding to an air exhaust level; retrieves, from the selected cleaning liquid feeding cycle table, a time interval corresponding to the retrieved allowable amount of water vapor to be evaporated; and controls the cleaning liquid feeding section 20 to perform a cleaning liquid feeding operation depending on the retrieved time interval.

In the fifth embodiment, the temperature-humidity table T1 as shown in FIG. 4 may be a simple table showing a relation between temperatures near 45° C. and humidities. Also, the cleaning liquid feeding cycle tables to be used in the fifth embodiment may indicate allowable amounts of water vapor to be evaporated corresponding to the temperatures near 45° C.

As described above, in the arrangement of the fifth embodiment, wherein the temperature adjusting section 35 is additionally provided in the image forming apparatus 1, the cleaning liquid feeding cycle may be defined, considering an operation status of the temperature adjusting section 35, in addition to an operation status of the air exhaust section 31.

Sixth Embodiment

Figure 19:
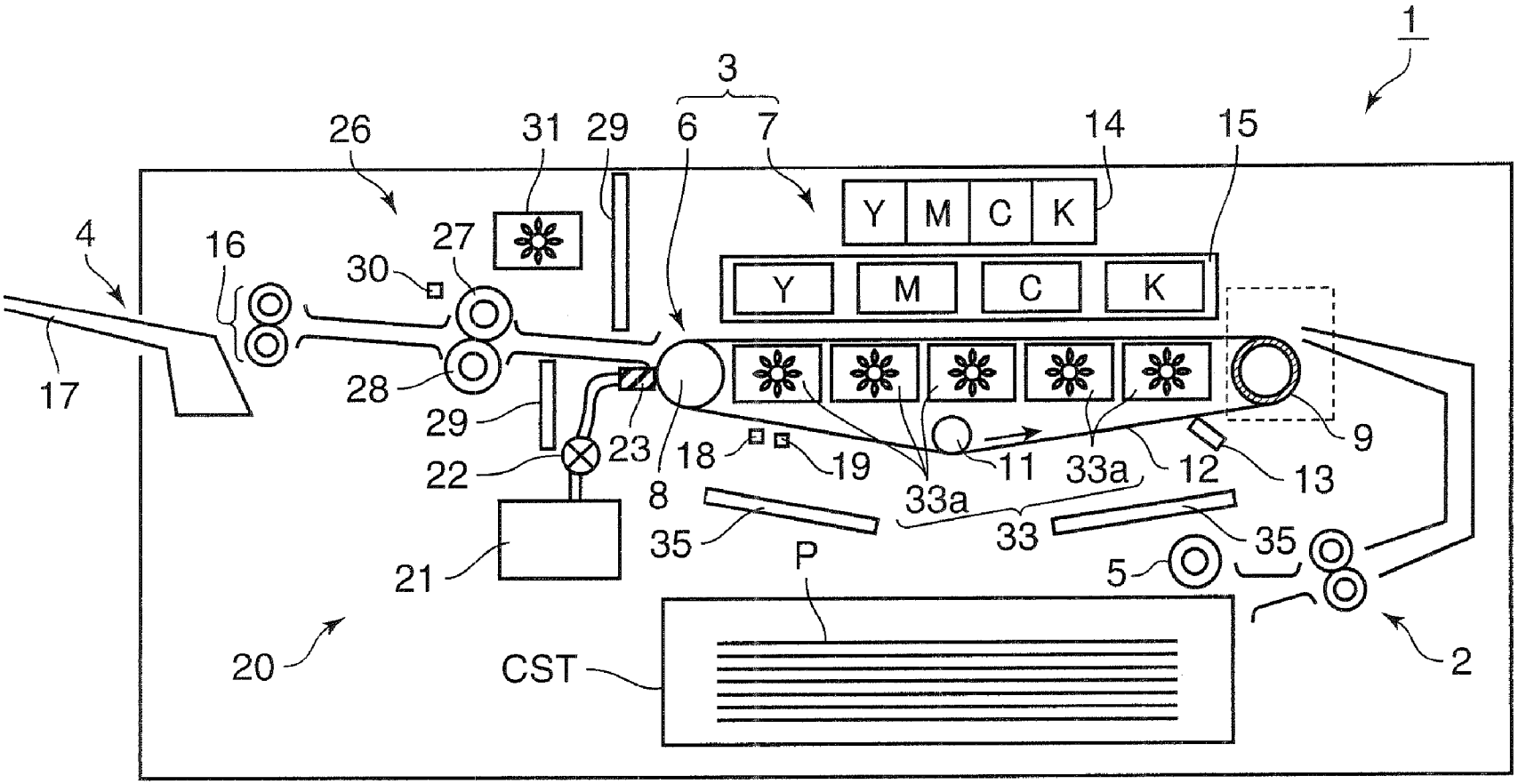
FIG. 19 is a diagram showing an arrangement of an image forming apparatus in accordance with a sixth embodiment of the invention.
Figure 20:
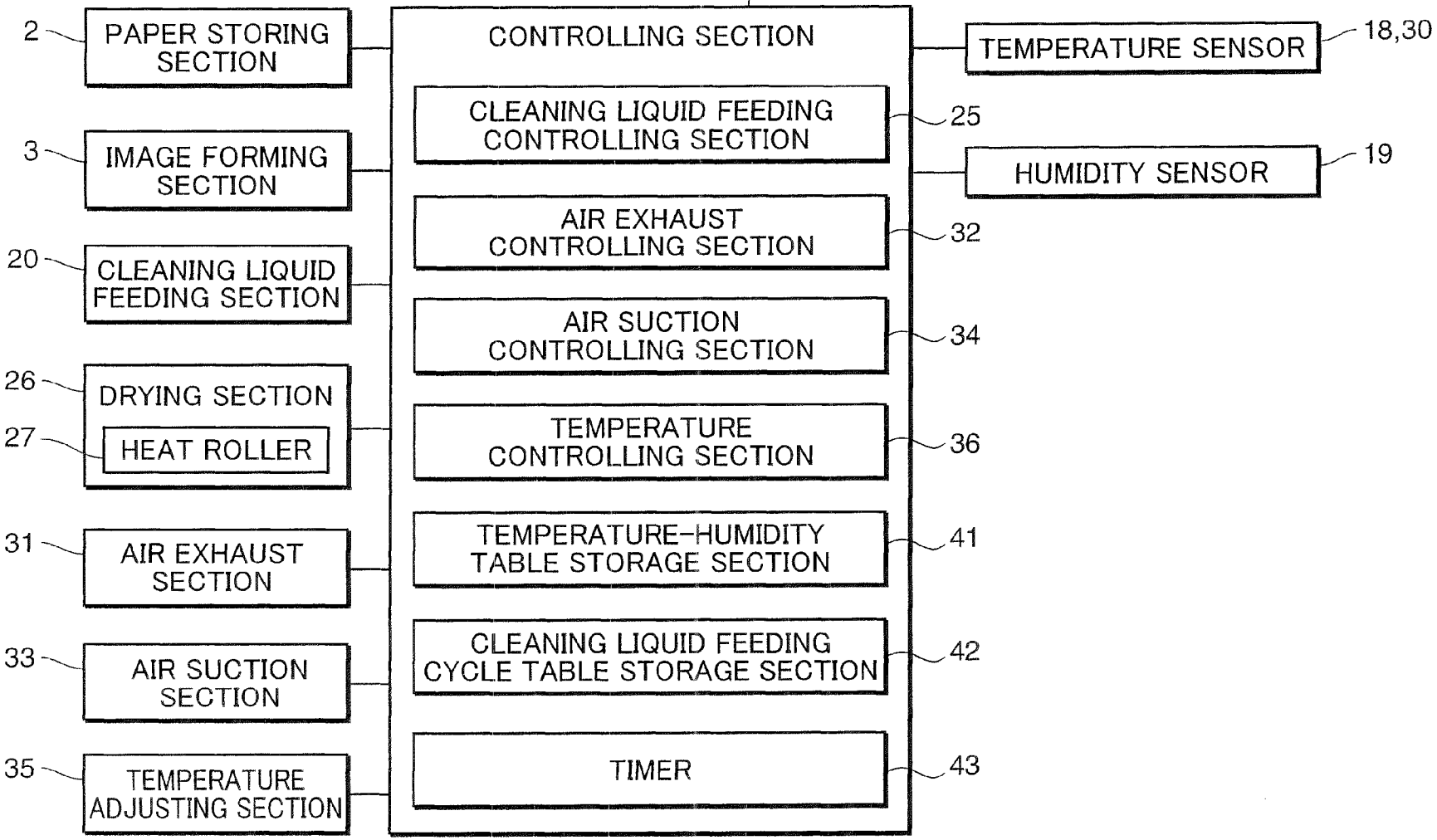
FIG. 20 is a block diagram showing an electrical configuration of the image forming apparatus as the sixth embodiment of the invention.

FIG. 19 is a diagram showing an arrangement of an image forming apparatus in accordance with the sixth embodiment of the invention. FIG. 20 is a block diagram showing an electrical configuration of the image forming apparatus 1 in the sixth embodiment. As shown in FIGS. 19 and 20, the arrangement of the image forming apparatus 1 in the sixth embodiment is substantially the same as the arrangement of the image forming apparatus 1 in the fourth embodiment except that the image forming apparatus 1 in the sixth embodiment is provided with a temperature adjusting section 35 and a temperature controlling section 36 in addition to elements corresponding to the elements in the fourth embodiment. As described above, in the case where the image forming apparatus 1 is provided with the temperature adjusting section 35 and the temperature controlling section 36, in addition to a drying section 26, a heat shielding plate 29, a temperature sensor 30, an air exhaust section 31, an air suction section 33, an air exhaust controlling section 32, and an air suction controlling section 34, the cleaning liquid feeding cycle may be defined, considering an operation status of the temperature adjusting section 35, in addition to operation statuses of the air exhaust section 31 and the air suction section 33.

Specifically, a cleaning liquid feeding cycle table storage section 42 in the sixth embodiment stores a cleaning liquid feeding cycle tables showing a relation between an allowable amount of water vapor to be evaporated, and a time interval at which a cleaning liquid is to be fed from a cleaning liquid feeding section 20, with respect to each of combinations of air exhaust levels, air suction levels, and temperatures to be adjusted by the temperature adjusting section 35.

A cleaning liquid feeding controlling section 25 retrieves, from the temperature-humidity table T1 as shown in FIG. 4, an allowable amount of water vapor to be evaporated corresponding to a temperature detected by a temperature sensor 18 and a humidity detected by a humidity sensor 19; selects one of the second through the sixth cleaning liquid feeding cycle tables T3 through T7 corresponding to a combination of an executing air exhaust level and an executing air suction level; retrieves, from the selected cleaning liquid feeding cycle table, a time interval corresponding to the retrieved allowable amount of water vapor to be evaporated; and controls the cleaning liquid feeding section 20 to perform a cleaning liquid feeding operation depending on the retrieved time interval.

In the sixth embodiment, the temperature-humidity table T1 as shown in FIG. 4 may be a simple table showing a relation between temperatures near 45° C. and humidities. Also, the cleaning liquid feeding cycle tables to be used in the fifth embodiment may indicate allowable amounts of water vapor to be evaporated corresponding to the temperatures near 45° C.

The present invention may embrace the following modification in addition to the first through the sixth embodiments.

In the case where a system provided with the image forming apparatus 1 is configured in such a manner that the ambient humidity of a location e.g. a printing room or a like room where the image forming apparatus 1 is installed is adjusted by an unillustrated humidity adjusting section, based on a humidity detected by the humidity sensor 19, the cleaning liquid feeding cycle may be defined depending on an operation status of the humidity adjusting section.

This application is based on Japanese Patent Application No. 2007-196298 filed on Jul. 27, 2007, the contents filed on Jul. 27, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a transporter for transporting a sheet;

an image forming section for forming an image on the sheet being transported by the transporter with an ink;

a liquid absorbent member;

a cleaning liquid feeding section for feeding a cleaning liquid to the transporter via the liquid absorbent member to clean the transporter adhered with ink residues;

a cleaning liquid feeding controlling section for controlling the cleaning liquid feeding section to perform the cleaning liquid feeding operation, based on an allowable amount of water vapor to be evaporated in ambient air in an interior of the image forming apparatus a temperature detecting section for detecting an ambient temperature in an interior of the image forming apparatus; and a humidity detecting section for detecting an ambient humidity in the interior of the image forming apparatus, wherein the cleaning liquid feeding controlling section retrieves an amount of saturated water vapor per unit volume relative to an ambient air in the interior of the image forming apparatus, and an amount of water vapor per unit volume actually contained in the ambient air in the interior of the image forming apparatus, based on the ambient temperature detected by the temperature detecting section and the ambient humidity detected by the humidity detecting section, and controls the cleaning liquid feeding section to perform the cleaning liquid feeding operation depending on a difference between the retrieved actual water vapor amount and the retrieved saturated water vapor amount.

2. The image forming apparatus according to claim 1, wherein the cleaning liquid feeding controlling section controllably increases an amount of the cleaning liquid to be fed per unit time, as the difference is increased.

3. The image forming apparatus according to claim 1, further comprising:

a temperature-humidity table storage section for storing a temperature-humidity table showing a relation between the ambient temperature in the interior of the image forming apparatus, the ambient humidity in the interior of the image forming apparatus, and the difference; and a cleaning liquid feeding cycle table storage section for storing one or more cleaning liquid feeding cycle tables showing a relation between the difference, and a time interval at which the cleaning liquid is to be fed from the cleaning liquid feeding section, wherein the cleaning liquid feeding controlling section retrieves, from the temperature-humidity table, the difference corresponding to the ambient temperature detected by the temperature detecting section and the ambient humidity detected by the humidity detecting section, retrieves, from the cleaning liquid feeding cycle table, the time interval corresponding to the retrieved difference, and controls the cleaning liquid feeding section to perform the cleaning liquid feeding operation depending on the retrieved time interval.

4. The image forming apparatus according to claim 1, further comprising:

a drying section for drying the sheet having the image formed by the image forming section by heating; and an air exhaust section for exhausting an ambient air in an interior of the image forming apparatus to an outside of the image forming apparatus, wherein the cleaning liquid feeding controlling section controls the cleaning liquid feeding section to perform the cleaning liquid feeding operation, considering an operation status of the air exhaust section.

5. The image forming apparatus according to claim 4, wherein the air exhaust section exhausts the ambient air in the interior of the image forming apparatus to the outside of the image forming apparatus depending on one of multiple air exhaust levels of the air exhaust section, and the cleaning liquid feeding controlling section controllably increases an amount of the cleaning liquid to be fed per unit time, as the air exhaust level of the air exhaust section is increased.

6. The image forming apparatus according to claim 5, further comprising:

a temperature detecting section for detecting an ambient temperature in the interior of the image forming apparatus;

a humidity detecting section for detecting an ambient humidity in the interior of the image forming apparatus;

a temperature-humidity table storage section for storing a temperature-humidity table showing a relation between the ambient temperature in the interior of the image forming apparatus, the ambient humidity in the interior of the image forming apparatus, and a difference between an amount of saturated water vapor per unit volume relative to the ambient air in the interior of the image forming apparatus, and an amount of water vapor per unit volume actually contained in the ambient air in the interior of the image forming apparatus; and a cleaning liquid feeding cycle table storage section for storing one or more cleaning liquid feeding cycle tables showing a relation between the difference, and a time interval at which the cleaning liquid is to be fed from the cleaning liquid feeding section, with respect to each of the air exhaust levels, wherein the cleaning liquid feeding controlling section retrieves, from the temperature-humidity table, the difference corresponding to the ambient temperature detected by the temperature detecting section and the ambient humidity detected by the humidity detecting section, selects one of the cleaning liquid feeding cycle tables corresponding to the air exhaust level of the air exhaust section, retrieves, from the selected cleaning liquid feeding cycle tables, the time interval corresponding to the retrieved difference, and controls the cleaning liquid feeding section to perform the cleaning liquid feeding operation depending on the retrieved time interval.

7. The image forming apparatus according to claim 1, further comprising:

an air suction section for pneumatically attracting the sheet to a transport surface of the transporter, wherein the cleaning liquid feeding controlling section controls the cleaning liquid feeding section to perform the cleaning liquid feeding operation depending on an operation status of the air suction section.

8. The image forming apparatus according to claim 7, wherein the air suction section pneumatically attracts the sheet to the transport surface depending on one of multiple air suction levels of the air suction section, and the cleaning liquid feeding controlling section controllably increases an amount of the cleaning liquid to be fed per unit time, as the air suction level of the air suction section is increased.

9. The image forming apparatus according to claim 8, further comprising:

a temperature detecting section for detecting an ambient temperature in an interior of the image forming apparatus;

a humidity detecting section for detecting an ambient humidity in the interior of the image forming apparatus;

a temperature-humidity table storage section for storing a temperature-humidity table showing a relation between the ambient temperature in the interior of the image forming apparatus, the ambient humidity in the interior of the image forming apparatus, and a difference between an amount of saturated water vapor per unit volume relative to an ambient air in the interior of the image forming apparatus, and an amount of water vapor per unit volume actually contained in the ambient air in the interior of the image forming apparatus; and a cleaning liquid feeding cycle table storage section for storing one or more cleaning liquid feeding cycle tables showing a relation between the difference, and a time interval at which the cleaning liquid is to be fed from the cleaning liquid feeding section, with respect to each of the air suction levels, wherein the cleaning liquid feeding controlling section retrieves, from the temperature-humidity table, the difference corresponding to the ambient temperature detected by the temperature detecting section and the ambient humidity detected by the humidity detecting section, selects one of the cleaning liquid feeding cycle tables corresponding to the air suction level of the air suction section, retrieves, from the selected cleaning liquid feeding cycle tables, the time interval corresponding to the retrieved difference, and controls the cleaning liquid feeding section to perform the cleaning liquid feeding operation depending on the retrieved time interval.

10. The image forming apparatus according to claim 1, wherein the cleaning liquid feeding controlling section controls the cleaning liquid feeding section to cyclically perform the cleaning liquid feeding operation in such a manner that a time interval at which the cleaning liquid feeding operation is cyclically performed is changed, based on the condition of the image forming apparatus relating to evaporation of the cleaning liquid.

11. The image forming apparatus according to claim 1, further comprising:

a cleaning blade for scraping a solution containing the cleaning liquid from a transport surface of the transporter to clean the transporter.

12. An image forming apparatus, comprising:

a transporter for transporting a sheet;

an image forming section for forming an ink image on the sheet being transported by the transporter, a liquid absorbent member;

a cleaning liquid feeding section for feeding a cleaning liquid to the transporter via the liquid absorbent member to clean the transporter adhered with ink residues;

at least one detecting section for detecting at least one ambient condition in an interior of the image forming apparatus that is indicative of an amount of water vapor to be evaporated in the interior of the image forming apparatus, the at least one detecting section comprising an ambient temperature detecting section for detecting an ambient temperature condition in the interior of the image forming apparatus; and a cleaning liquid feeding controlling section connected to the detecting section for controlling the cleaning liquid feeding section to perform the cleaning liquid feeding operation based on the ambient condition in the interior of the image forming apparatus detected by the detecting section.

13. The image forming apparatus according to claim 12, wherein the at least one detecting section comprises an ambient humidity detecting section for detecting an ambient humidity condition in an interior of the image forming apparatus.

14. The image forming apparatus according to claim 12, wherein the cleaning liquid feeding controlling section controls the cleaning liquid feeding section to cyclically perform the cleaning liquid feeding operation in such a manner that a time interval at which the cleaning liquid feeding operation is cyclically performed is changed based on the ambient condition in the interior of the image forming apparatus detected by the detecting section.

15. An image forming apparatus, comprising:

a transporter for transporting a sheet;

an image forming section for forming an ink image on the sheet being transported by the transporter;

a liquid absorbent member;

a cleaning liquid feeding section for feeding a cleaning liquid to the transporter via the liquid absorbent member to clean the transporter adhered with ink residues;

at least one detecting section for detecting at least one ambient condition in an interior of the image forming apparatus that is indicative of an amount of water vapor to be evaporated in the interior of the image forming apparatus, the at least one detecting section comprising an ambient humidity detecting section for detecting an ambient humidity condition in an interior of the image forming apparatus; and a cleaning liquid feeding controlling section connected to the detecting section for controlling the cleaning liquid feeding section to perform the cleaning liquid feeding operation based on the ambient condition in the interior of the image forming apparatus detected by the detecting section.

16. The image forming apparatus according to claim 15, wherein the at least one detecting section further comprises an ambient temperature detecting section for detecting an ambient temperature condition in the interior of the image forming apparatus.

17. The image forming apparatus according to claim 15, wherein the cleaning liquid feeding controlling section controls the cleaning liquid feeding section to cyclically perform the cleaning liquid feeding operation in such a manner that a time interval at which the cleaning liquid feeding operation is cyclically performed is changed based on the ambient condition in the interior of the image forming apparatus detected by the detecting section.

* * * * *